US012139783B2

(12) United States Patent
Gatehouse et al.

(10) Patent No.: US 12,139,783 B2
(45) Date of Patent: Nov. 12, 2024

(54) COPPER-BERYLLIUM ALLOY WITH HIGH STRENGTH

(71) Applicant: MATERION CORPORATION, Mayfield Heights, OH (US)

(72) Inventors: John E. Gatehouse, Mayfield Heights, OH (US); Michael J. Gedeon, Mayfield Heights, OH (US); Fritz Grensing, Mayfield Heights, OH (US); Bruce D. Schmeck, Mayfield Heights, OH (US); Jeffrey S. Hoyer, Mayfield Heights, OH (US); Michael F. Tyson, Mayfield Heights, OH (US); Karl R. Ziegler, Mayfield Heights, OH (US)

(73) Assignee: Materion Corporation, Mayfield Heights, OH (US)

( * ) Notice: Subject to any disclaimer, the term of this patent is extended or adjusted under 35 U.S.C. 154(b) by 10 days.

(21) Appl. No.: 17/609,088

(22) PCT Filed: May 5, 2020

(86) PCT No.: PCT/US2020/031449
§ 371 (c)(1),
(2) Date: Nov. 5, 2021

(87) PCT Pub. No.: WO2020/231674
PCT Pub. Date: Nov. 19, 2020

(65) Prior Publication Data

US 2022/0220597 A1 Jul. 14, 2022

Related U.S. Application Data

(60) Provisional application No. 62/846,261, filed on May 10, 2019.

(51) Int. Cl.
*C22F 1/08* (2006.01)
*C22C 9/00* (2006.01)

(52) U.S. Cl.
CPC . *C22F 1/08* (2013.01); *C22C 9/00* (2013.01)

(58) Field of Classification Search
CPC ..... C22F 1/08; C22C 9/00
See application file for complete search history.

(56) References Cited

U.S. PATENT DOCUMENTS 4,425,168 A * 1/1984 Goldstein ..... C22F 1/08 148/414
4,551,187 A 11/1985 Church et al.
(Continued)

FOREIGN PATENT DOCUMENTS

TW 201900891 A 1/2019

OTHER PUBLICATIONS

International Application No. PCT/US2020/031449, International Search Report mailed Jul. 30, 2020, 2 pages.

*Primary Examiner* — John A Hevey
(74) *Attorney, Agent, or Firm* — COZEN O'CONNOR

(57) ABSTRACT

A process for producing a copper-beryllium alloy product. The process comprises preparing a base alloy having 0.15 wt %-4.0 wt % beryllium and having grains and an initial cross section area. The process further comprises cold working the base alloy to a percentage of cold reduction of area (CRA) greater than 40%, based on the initial cross section area, and heat treating the cold worked alloy to produce the copper-beryllium alloy product. The grain structure of the copper-beryllium alloy product has an orientation angle of less than 45° when viewed along the direction of the cold working. The copper-beryllium alloy product demonstrates a fatigue strength of at least 385 MPa after $10^6$ cycles of testing.

20 Claims, 12 Drawing Sheets

(56) References Cited

U.S. PATENT DOCUMENTS

| | | | | |
|---|---|---|---|---|
| 4,724,013 | A * | 2/1988 | Church | C22C 9/06 148/411 |
| 2004/0216817 | A1* | 11/2004 | Harkness | C22F 1/08 420/494 |
| 2015/0225817 | A1* | 8/2015 | Miura | H01B 1/026 148/411 |

* cited by examiner

COPPER-BERYLLIUM ALLOY WITH HIGH STRENGTH

PRIORITY CLAIM

This application claims priority to U.S. Provisional Patent Application No. 62/846,261, filed May 10, 2019, the entirety of which is incorporated herein by reference.

FIELD

The present disclosure relates to processes for enhancing strength characteristics of copper-beryllium alloys and to copper-beryllium alloys having ultra-high strength.

BACKGROUND

Copper-beryllium alloys are used in various industrial and commercial applications due to their strength, resilience, and fatigue resistance. For example, products made from conventional copper-beryllium alloys are used in voice coil motor (VCM) and/or optical image stabilization (OIS) technologies where various mechanical and electrical designs are used to provide high-resolution, auto-focus, optical zooming camera capability in mobile electronic devices. When used for these technologies, the alloy products are typically cut into extremely small, thin strips so as to be able to fit within confined spaces to increase portability and functionality of the mobile electronic device. The small size of the strip requires very high strength in the alloy product that is used. As the electronic devices become more compact, the strength requirements for the alloy products continue to increase. Conventional copper-beryllium alloy products produced using conventional processes, however, have been found to fail to meet these ever-increasing strength requirements.

Likewise, copper-nickel-tin alloys may also be used in these applications. However, these copper-nickel-tin alloys have had difficulty meeting the high strength requirements demanded by some of the mobile electronics applications.

Further, copper-beryllium alloy products and/or copper-nickel-tin alloy products produced using conventional processes often exhibit significant variation in strength characteristics, depending on the direction of processing, and the strength characteristics in the various directions often compete with one another. For example, although certain processes may improve strength characteristics, e.g., ultimate tensile strength, along the direction of cold working, the processes typically cause the alloy products to exhibit reduced or inferior strength characteristics in other directions, e.g., transverse to the direction of cold working. Such anisotropy in the strength characteristics imposes limitations on how the alloy can be subsequently processed and/or fitted into the final product.

As one example of a conventional copper-beryllium alloy produced using a conventional method, U.S. Pat. No. 5,354,388 discusses a process for producing the beryllium-copper alloy comprising the steps of casting a beryllium-copper alloy composed essentially of 1.00 to 2.00% by weight of Be, 0.18 to 0.35% by weight of Co, and the balance being Cu, rolling the cast beryllium-copper alloy, annealing the alloy at 500° to 800° C. for 2 to 10 hours, then cold rolling the annealed alloy at a reduction rate of not less than 40%, annealing the cold rolled alloy again at 500° to 800° C. for 2 to 10 hours, thereafter cold rolling the alloy to a desired thickness, and subjecting the annealed alloy to a final solid solution treatment. The beryllium-copper alloy obtained by this process is also disclosed, in which an average grain size is not more than 20 and a natural logarithm of a coefficient of variation of the grain size is not more than 0.25.

As another example, Japanese Patent Application No. JP22850084A relates to manufacturing a high strength Be—Cu alloy having superior mechanical strength and electric conductivity without requiring a long time for final age hardening by subjecting a Be—Cu alloy to soln. heat treatment, primary age hardening, cold working and secondary age hardening. The Be—Cu alloy consisting of, by weight, 0.2-0.7% Be, 1.4-2.2% Ni, 2.4-2.7% Co and the balance Cu is subjected to soln. heat treatment by heating at 930° C. for 3 min. The alloy is preliminarily cold worked as required, and it is subjected to primary age hardening at 350-450° C., cold working at ≥20% working rate and secondary age hardening at 350-500° C. The secondary age hardening is finished in a short time and a Be—Cu alloy having superior mechanical strength and electric conductivity is obtained.

Additionally, Japanese Patent Application No. JP63125647A discusses developing a Cu—Be alloy having excellent electrical conductivity, strength and workability by subjecting the Cu—Be alloy containing Co, Ni, etc., to a heat treatment under specific conditions. The ingot of the Cu alloy containing 0.05-2.0 wt % Be, and 0.1-10.0% at least one of Co and Ni is subjected to a solution heat treatment at 800-1,000° C. to solutionize the precipitated particles which are coarse and unsolutionized into a matrix. The alloy is then subjected to cold working to permit easy generation of the deposition nuclei and thereafter, the alloy is subjected to annealing at a temperature lower than 750-950° C. solutionization temperature, more preferably at the temperature at which the difference therebetween is 20-200° C., then to an ordinary age hardening treatment. The Cu—Be alloy in which part of the solute is dispersed in the fine state of ≤0.3 μm grain size and which has the high electrical conductivity as well as the excellent strength and workability is obtained.

Further, U.S. Pat. No. 5,131,958 discusses a method of hot forming beryllium-copper alloy including from 1.60 to 2.00% by weight of Be, from 0.2 to 0.35% by weight of Co and the balance being essentially Cu, under specified conditions of a working temperature, a working rate, and an amount of work strain to produce a hot formed product of an equiaxed grain structure having a uniform stable grain size.

Furthermore, U.S. Pat. No. 4,425,168A discusses a process for producing a copper beryllium alloy. The process includes the steps of: preparing a copper beryllium melt; casting the melt; hot working the cast copper beryllium; annealing the copper beryllium; cold working the annealed copper beryllium; and hardening the copper beryllium; and is characterized by the improvement comprising the steps of: solution annealing the cold worked copper beryllium at a temperature of from 1275° (691°) to 1375° F. (746° C.); hardening the annealed copper beryllium at a temperature of from 400° (204°) to 580° F. (304° C.); cold rolling the hardened copper beryllium; and stress relief annealing the cold worked copper beryllium at a temperature of from 400° (204°) to 700° F. (371° C.). The alloy consisting essentially of, in weight percent, from 0.4 to 2.5% beryllium, up to 3.5% of material from the group consisting of cobalt and nickel, up to 0.5% of material from the group consisting of titanium and zirconium, up to 0.3% iron, up to 0.7% silicon, up to 0.3% aluminum, up to 1.0% tin, up to 3.0% zinc, up to 1.0% lead, balance essentially copper. The alloy is characterized by equiaxed grains. The grains have an average grain size of less than 9 microns. Substantially all of the grains are less than 12 microns in size.

Even in view of the references, the need exists for copper-beryllium alloy products that have improved strength characteristics, e.g., fatigue strength, tensile strength, and/or yield strength (in multiple directions), and for improved processes for producing these alloy products.

SUMMARY

In one embodiment, the disclosure relates to a process for producing a copper-beryllium alloy product, the process comprises the steps of preparing a base alloy having 0.5 wt %-4.0 wt % beryllium and having grains and an initial cross section area; cold working the base alloy to a percentage of cold reduction of area (CRA) greater than 40%, based on the initial cross section area, e.g., from 70% to 80%; and heat treating the cold worked alloy to produce the copper-beryllium alloy product. The grain structure of the copper-beryllium alloy product has an orientation angle of less than 45°, e.g., less than 15°, relative to the cold working surfaces, when viewed along the direction of the cold working. The copper-beryllium alloy product demonstrates a fatigue strength of at least 385 MPa after $10^6$ cycles of testing and/or an ultimate tensile strength of at least 200 ksi along the direction of the cold working and/or a 0.2% offset yield strength of at least 200 ksi along the direction of the cold working. The ultimate tensile strength of the copper-beryllium alloy product as measured transverse to the direction of the cold working is greater than the ultimate tensile strength as measured in the direction of the cold working by 5% to 10%. The heat treating may be performed at a temperature of 600° F. to 700° F. for a period of 1 minutes to 5 minutes. The preparation of the base alloy may comprise preliminarily cold working an alloy sheet to a thickness of less than 0.01 inches, heat treating the preliminarily cold worked alloy to produce the base alloy, and/or solution annealing, e.g., at a temperature of 1350° F. to 1450° F. for a period of 0.5 minutes to 5 minutes, and aging, e.g., at a temperature of 450° F. to 650° F. for a period of 2 hours to 4 hours. The 0.2% offset yield strength of the copper-beryllium alloy product as measured transverse to the direction of the cold working may be greater than the 0.2% offset yield strength as measured in the direction of the cold working by 5% to 10% and/or the ultimate tensile strength of the cold worked alloy may be greater than the ultimate tensile strength of the base alloy by 10% to 30% and/or the ultimate tensile strength of the copper-beryllium alloy product may be greater than the ultimate tensile strength of the base alloy by 15% to 50% and/or the 0.2% offset yield strength of the cold worked alloy product may be greater than the 0.2% offset yield strength of the base alloy by 20% to 40% and/or the 0.2% offset yield strength of the copper-beryllium alloy product may be greater than the 0.2% offset yield strength of the base alloy by 25% to 70%. The grains of the copper-beryllium alloy product may be elongated in the direction of the cold working and/or may have an aspect ratio of length to thickness greater than 1:1. The amount of fatigue initiation sites in the copper-beryllium alloy product is less than the amount of fatigue initiation sites in the base alloy by an amount of 1% to 35%.

In one embodiment, the disclosure relates to the copper-beryllium alloy product. The grains of which may have an aspect ratio of length to thickness ranging from 1:1 to 9:1 an/or a grain structure orientation angle is less than 15°. The copper-beryllium alloy product may have an ultimate tensile strength of at least 200 ksi transverse to the direction of the grain elongation. The copper-beryllium alloy product may have a 0.2% offset yield strength of at least 200 ksi along the direction of the grain elongation and/or a 0.2% offset yield strength of at least 200 ksi transverse to the direction of the grain elongation. The 0.2% offset yield strength transverse to the direction of the grain elongation may be greater than the 0.2% offset yield strength in the direction of the grain elongation by 5% to 10%. The copper-beryllium alloy product may include less than 0.2 wt % of titanium, less than 0.2 wt % of tin, and/or from 1.8-2.0% beryllium.

BRIEF DESCRIPTION OF THE DRAWINGS

A further understanding of the nature and advantages of the disclosed technology may be realized by reference to the remaining portions of the specification and the drawings.

DETAILED DESCRIPTION

Figure 1:
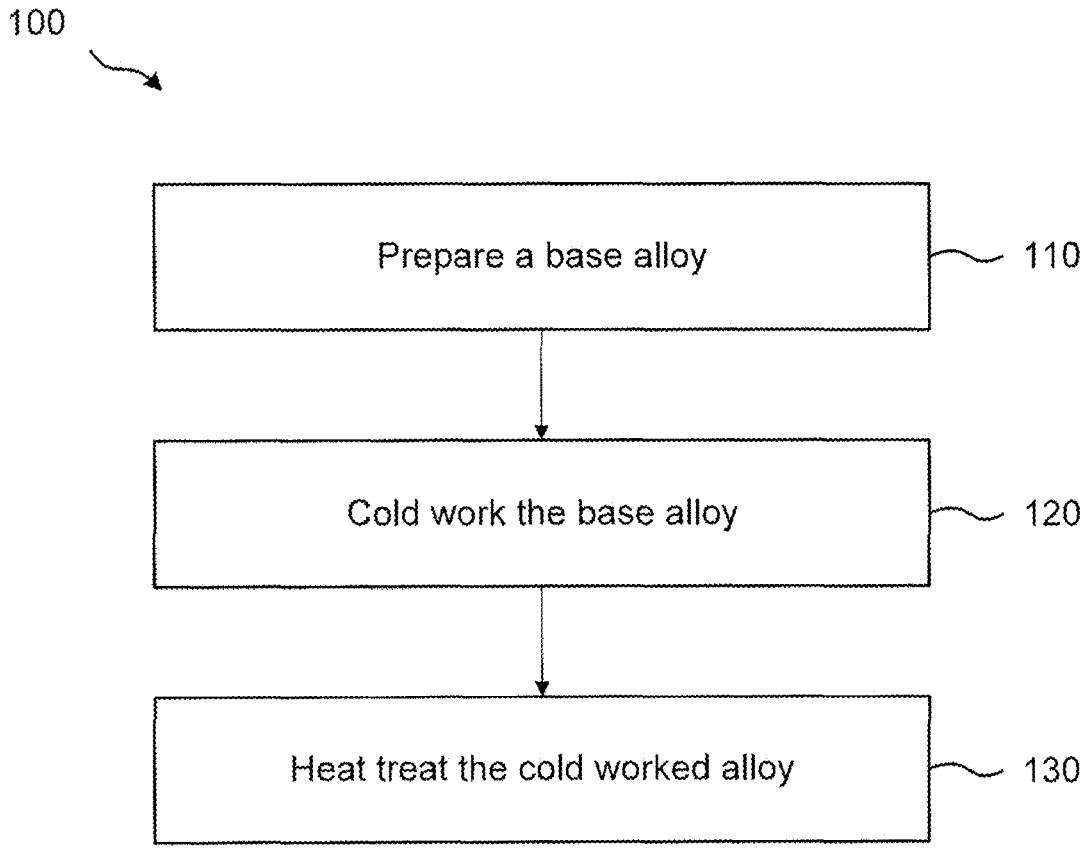
FIG. 1 is a flowchart that shows select operations of an exemplary process for working or processing copper-beryllium alloy products.

As discussed above, conventional copper-beryllium alloy products and/or copper-nickel-tin alloy products do not meet the increased strength requirements as demanded by the ever-evolving mobile device technologies. According to some embodiments, by cold working a beryllium-containing base alloy, such as a base copper-beryllium alloy, to specific percentages of cold reduction of area (CRA) in a (final) cold working operation, an improved beryllium-containing alloy product, such as a copper-beryllium alloy product, may be obtained. The beryllium-containing alloy product may have elongated and/or non-uniform grain microstructure, and may demonstrate superior strength characteristics, e.g., ultra-high fatigue strength, tensile strength, and/or yield strength. These strength characteristics have not been achieved by conventional beryllium-containing alloy products (e.g., copper-beryllium alloy products) and/or other non-beryllium containing alloy products (e.g., copper-nickel-tin alloy products).

Some conventional processes employ different cold working steps and a final annealing (e.g., by overaging) step, with the desired result being uniformity of structure. Thus, the resultant product has a uniform (and often equiaxed), non-elongated grain structure, and the grains generally have lower aspect ratios (length to thickness), e.g., roughly equal to 1:1. The grain structure orientation of these alloys is unknown. However, this uniform grain structure has been found to contribute to the higher presence grain boundaries (on the surface of the strip). And these grain boundaries provide for higher amounts of fatigue crack initiation sites, particularly when they meet the edge of the strip. These initiation sites, in turn, lead to reductions in strength characteristics. In contrast, in the disclosed alloy products, the grain structure is elongated (with higher aspect ratios). And the elongated grains provide significantly fewer surface grain boundaries, thus reducing the number of potential crack initiation sites. Further, grain boundaries oriented along the plane of principle shear stress (45° relative to the surface) provide easy slip planes for fatigue crack initiation. Such configurations are prevalent in equiaxed grains (such as those in conventional alloys), but virtually nonexistent in elongated grains (such as those in the disclosed alloy products).

Importantly, the copper-beryllium alloy products disclosed herein further demonstrate improved strength characteristics in all directions. Unexpectedly, the copper-beryllium alloy products described herein not only demonstrate improved strength characteristics along the direction of the cold working, but also demonstrates improved or even better strength characteristics in other directions, e.g., the direction transverse to the direction of the cold working. This beneficially provides flexibility for subsequent processing and fitting of the alloy product, such as alloy strips, into other products or devices. Typically, performance improvements in the direction of the cold working compete with performance in other directions.

In addition, the disclosed processes employ fewer steps, e.g., fewer cold working and/or heat treating steps, which beneficially provides for efficiency advantages over conventional process that require more process steps.

Composition

The copper-beryllium alloy product described herein generally comprises copper and beryllium. In some cases, the beryllium is present in an amount (significantly) lesser than that of the copper. In some embodiments, the alloy product comprises from 0.15 wt % to 4.0 wt % beryllium, e.g., from 0.15 wt % to 3 wt %, from 0.15 wt % to 2.0 wt %, from 0.5 wt % to 4.0 wt %, from 0.8 wt % to 3.0 wt %, from 1.0 wt % to 3.0 wt %, from 1.2 wt % to 2.6 wt %, from 1.5 wt % to 2.5 wt %, from 1.8 wt % to 2.0 wt %, or from 1.85 wt % to 1.95 wt %. In terms of lower limits, the alloy product may comprise greater than 0.15 wt % beryllium, e.g., greater than 0.5 wt %, greater than 0.8 wt %, greater than 1.0 wt %, greater than 1.2 wt %, greater than 1.5 wt %, greater than 1.6 wt %, greater than 1.7 wt %, greater than 1.8 wt %, greater than 1.85 wt %, greater than 1.9 wt %, or greater than 1.95 wt %. In terms of upper limits, the alloy product may comprise less than 4.0 wt % beryllium, e.g., less than 3.0 wt %, less than 2.6 wt %, less than 2.5 wt %, or less than 2.0 wt %.

In some embodiments, the alloy product comprises from 96 wt % to 99.5 wt % copper, e.g., from 97 wt % to 99.5 wt %, from 98 wt % to 99.5 wt %, from 99 wt % to 99.5 wt %, from 96 wt % to 99 wt %, from 97 wt % to 99 wt %, from 98 wt % to 99 wt %, from 96 wt % to 98 wt %, from 97 wt % to 98 wt %, or from 96 wt % to 97 wt %. In terms of lower limits, the alloy product may comprises greater than 96 wt % copper, e.g., greater than 97 wt %, greater than 98 wt %, or greater than 99 wt %. In terms of upper limits, the alloy product may comprises less than 99.5 wt % copper, e.g., less than 99 wt %, less than 98 wt %, or less than 97 wt %.

In some embodiments, the alloy product comprises additional alloying elements, such as cobalt, nickel, zirconium, or combinations thereof. For example, the copper-beryllium alloy product described herein may include from 0 wt % to 3 wt % additional alloying element(s), e.g., from 0 wt % to 2.7 wt %, from 0 wt % to 2.5 wt %, from 0.1 wt % to 2.5 wt %, from 0.1 wt % to 2 wt %, from 0.2 wt % to 1.5 wt %, from 0.2 wt % to 1 wt %, from 0.3 wt % to 0.8 wt %, or from 0.3 wt % to 0.6 wt %. In terms of lower limits, the copper-beryllium alloy product may include greater than 0.01 wt % additional alloying element(s), e.g., greater than 0.05 wt %, greater than 0.1 wt %, greater than 0.2 wt %, greater than 0.3 wt %, greater than 0.4 wt %, greater than 0.5 wt %, greater than 0.6 wt %, greater than 0.8 wt %, greater than 1 wt %, greater than 1.5 wt %, greater than 2 wt %, or greater than 2.5 wt %. In terms of upper limits, the copper-beryllium alloy product may include less than 3 wt % additional alloying element(s), e.g., less than 2.7 wt %, less than 2.5 wt %, less than 2 wt %, less than 1.5 wt %, less than 1 wt %, less than 0.8 wt %, less than 0.6 wt %, less than 0.5 wt %, less than 0.4 wt %, less than 0.3 wt %, less than 0.2 wt %, less than 0.1 wt %, or less than 0.05 wt %. The aforementioned ranges and limits may be applied to individual "additional alloying elements" or to combinations of "additional alloying elements."

In some embodiments, the alloy product described herein may include 1.8 wt % to 2.0 wt % of beryllium, 0.2 wt % or less of cobalt and nickel combined, 0.6 wt % or less of iron, nickel, and cobalt combined, 0.2 wt % or less of silicon, 0.2 wt % or less of aluminum, and 0.5 wt % or less of other impurities, with the remainder being copper. In some instances, the alloy product, or the base alloy contains little or no cobalt that is intentionally added.

In some cases, the copper-beryllium alloy product described herein may include trace amounts, if any, other elements, such as titanium, tin, lead, or zinc, or combinations thereof. For example, the copper-beryllium alloy product described herein may include less than 0.5 wt % other element(s), e.g., titanium tin, lead, zinc, etc., e.g., less than 0.4 wt %, less than 0.3 wt %, less than 0.2 wt %, less than 0.1 wt %, less than 0.05 wt %, less than 0.03 wt %, less than 0.01 wt %, or less than 0.005 wt %. In terms of ranges, the copper-beryllium alloy may include from 0.005 wt % to 0.5 wt % other element(s), e.g., from 0.01 wt % to 0.5 wt %, from 0.05 wt % to 0.5 wt %, from 0.1 wt % to 0.5 wt %, from 0.2 wt % to 0.5 wt %, or from 0.2 wt % to 0.4 wt %. The aforementioned ranges and limits may be applied to individual "other elements" or to combinations of "other elements."

As such, the alloy products advantageously require few components, e.g., only 2, only 3, only 4, only 5, only 6, only 7, or only 8, to achieve the desired performance characteristics, which provides for processing efficiencies, e.g., simplicity in alloy formation. Conventional alloys having higher numbers of components add unnecessary complexity to alloy formation and, importantly, increase the likelihood of intermetallics that, in turn, form reducing properties. These mixtures also create problems with the ability to recycle. By limiting the number of metals, the disclosed alloy products advantageously avoid these problems.

Properties and characteristics of the alloy product are discussed below.

Process

A process for producing a copper-beryllium alloy product is disclosed. The process comprises the step of preparing a base alloy, having grains, and having an initial cross section area. The base alloy may have the elemental composition discussed above, but in some cases, the other material characteristics of the base alloy will differ from those of the copper-beryllium alloy product that the process yields. The process may further comprise the step of cold working the base alloy to achieve a significant percentage of cold reduction of area (CRA), e.g., greater than 40%, based on the initial cross section area, thus producing a cold worked alloy. Additional discussion of CRA is provided herein. The grain structure of the grains (of the cold worked alloy and or of the resultant copper-beryllium alloy product) may have an orientation angle less than 45° when viewed along the direction of the cold working. The process further comprises the step of heat treating the cold worked alloy to produce the copper-beryllium alloy product. As a result, the copper-beryllium alloy product demonstrates improved performance characteristics, e.g., a fatigue strength of at least 385 MPa, e.g., at least 400 MPA, at least 450 MPa after $10^6$ cycles of testing. Additional performance characteristics are provided herein.

FIG. 1 is a flowchart that shows select operations of an exemplary process 100 for processing copper-beryllium alloys. The process 100 may begin by preparing a base alloy at operation 110. The base alloy may then be cold worked at operation 120 (to achieve a percentage of CRA greater than 40%). At operation 130, the cold worked alloy may be heat treated (to produce the copper-beryllium alloy product).

In some embodiments, the preparation of the base alloy may include casting a billet of a copper-beryllium alloy, e.g., having the composition as described herein. The preparation may further include one or more rolling operations to reduce a thickness of the billet to a desired thickness or simply to the base alloy thickness. The preparation of the base alloy may also include one or more heat treating operations, such as annealing operations, aging operations, etc., performed between and/or after the one or more rolling operations. More details of the preparation of the base alloy will be discussed in more detail below.

In some cases, cold working may be considered the process of mechanically altering the shape or size of the metal by plastic deformation. This can be done by rolling, drawing, pressing, spinning, extruding or heading of the metal or alloy. Without being bound by theory, when a metal is plastically deformed, dislocations of atoms occur within the material. Particularly, the dislocations occur across or within the grains of the metal. The dislocations overlap each other and the dislocation density within the material increases. The increase in overlapping dislocations makes the movement of further dislocations more difficult. This increases the hardness and tensile strength of the resulting alloy. Cold working also improves the surface finish of the alloy. Mechanical cold working is generally performed at a temperature below the recrystallization point of the alloy, and is usually done at room temperature.

The degree of deformation, or the percentage of cold working can be determined by measuring the change in the cross-sectional area of the alloy before and after cold working. Accordingly, the percentage of cold working is also referred to as the percentage of cold reduction of area (CRA), as mentioned above. The percentage of CRA can be determined according to the following formula:

$$\% \ CRA = 100 \times (A_o - A_f)/A_o$$

where $A_o$ is the initial or original cross-section area before cold working, and $A_f$ is the final cross-sectional area after cold working. It is noted that the change in cross-sectional area is usually due solely to changes in the thickness of the alloy, so the CRA can also be calculated using the initial and final thickness as well. It is further noted that the initial or original cross-sectional area or thickness used to determine the CRA carried out by a cold working operation is the cross-sectional area or thickness measured immediately before the instant cold working. Similarly, the final cross-sectional area or thickness used to determine the CRA carried out by the cold working operation is the cross-sectional area or thickness measured upon completion of the instant cold working operation. In other words, the CRA is specific to each cold working operation, and does not refer to a combined measurement of multiple cold working operations unless specified otherwise.

As noted above, the base alloy may be cold worked to achieve a significant percentage of CRA to achieve superior strength characteristics that may not be achieved by the conventional copper-beryllium alloys.

For example, by cold working the base alloy to a percentage of CRA of at least 40%, superior strength characteristics over copper-beryllium alloy products produced using conventional processes may be obtained. Depending on the strength characteristics desired in the final alloy product, the percentage of CRA achieved by the cold working may be greater than 40%, e.g., greater than 45%, greater than 50%, greater than 55%, greater than 60%, greater than 65%, greater than 70%, greater than 75%, greater than 80%, or greater than 85%. In terms of ranges, the percentage of CRA achieved by the cold working may range from 40% to 85%, e.g., from 40% to 80%, from 40% to 75%, from 40% to 70%, from 40% to 65%, from 40% to 60%, from 40% to 50%, from 50% to 85%, from 50% to 80%, from 50% to 75%, from 50% to 70%, from 50% to 65%, from 50% to 60%, from 60% to 85%, from 60% to 80%, from 60% to 75%, from 60% to 70%, from 60% to 65%, from 65% to 85%, from 65% to 80%, from 65% to 75%, from 65% to 70%, from 70% to 85%, from 70% to 80%, from 70% to 75%, from 75% to 85%, or from 75% to 80%. In terms of upper limits, the percentage of CRA achieved by the cold working may be less than 85% e.g., less than 80%, less than 75%, less than 70%, or less than 65%. As will be discussed below, depending on the percentages of the CRA performed, the characteristics of the final copper-beryllium alloy product may differ.

Further, by cold working the base alloy to select percentage of CRA as described herein, superior strength characteristics may be achieved for alloy products that may have different final thicknesses. In other words, even though the desired thickness of the final alloy product may vary, by cold working the base alloy to select percentage of CRA as described herein, superior strength characteristics may be consistently obtained. Thus, in some embodiments, the cold working operation may be considered as a CRA-driven operation in that it is performed in order to achieve a predetermined percentage of CRA, although the final alloy product thickness may vary. For purpose of description, this cold working operation to achieve a predetermined percentage of CRA may also be referred to as a CRA-driven operation. Further, this cold working operation is the final cold working operation performed to produce the copper-beryllium alloy product described herein, although additional heat treatment may follow in some cases. Thus, this cold working operation may also be referred to as the final cold working operation. The cold working step may vary widely, as long as the desired CRA is achieved. Rolling or drawing operations may be employed. In some cases, e.g., for formation of strips, cold rolling may be utilized.

In some embodiments, the process advantageously employs lesser amounts of cold working steps, as opposed to conventional processes, which require many cold working steps. The additional cold working steps detrimentally add complexity and resources to the overall process. For example, the process may employ fewer than 4 cold working steps, e.g., fewer than 3, or fewer than 2. In some cases, the process requires a single cold working step.

Upon completion of the cold working, the cold worked alloy may be heat treated to further improve at least some of the strength characteristics of the cold worked alloy. Heat treating metals or alloys may be referred to as a controlled process of heating and cooling the metals or alloys to alter their physical and mechanical properties without changing the product shape. Heat treatment is associated with increasing the strength of the material but it can also be used to alter certain manufacturability objectives such as to improve machining, improve formability, or to restore ductility after a cold working operation. In some cases, the heat treating may comprise multiple heat treating operations. In some embodiments, the heat treating comprises a single heat treating operations. In some cases, the heat treating comprises strand aging.

It is noted that the heat treating is performed to further improve at least some of the strength characteristics of the cold-worked alloy by, e.g., aging or precipitation hardening. Thus, the heat treating may be performed at a relatively low temperature for a relatively short duration (discussed below), and the grain structure may be substantially unchanged by the heat treating. That is, the gain structure may remain elongated, flattened, or compressed, similar to the grain structure obtained upon completion of the CRA-driven cold working. This is in contrast to the heat treating by annealing, which is typically the heat treating performed in conventional processes immediately following cold working. Such annealing, which is typically performed above 1,000° F. for extended period of time, e.g., hours, is performed to remove any non-uniformity resulted from the cold working so as to obtain a uniform, equiaxed grain structure for increased formability at the expense of strength of the alloy products.

To further improve at least some of the strength characteristics of the cold worked alloy, the heat treating may include an aging operation carried out by placing the cold worked alloy in a furnace or other similar assembly and exposing the base alloy to an elevated temperature in the range of from 600° F. to 700° F. for a time period of from 1 minute to 5 minutes. In some embodiments, the aging operation may be performed, for example, by placing the base alloy in strip form on a conveyor furnace apparatus, e.g., a strand aging furnace, and running the alloy strip at an appropriate rate through the conveyor furnace.

In some embodiments, the aging temperature, e.g., the elevated temperature to which the cold worked alloy may be exposed during the aging operation, may range from 500° F. to 800° F., e.g., from 600° F. to 700° F., from 600° F. to 680° F., from 600° F. to 660° F., from 600° F. to 640° F., from 600° F. to 620° F., from 620° F. to 700° F., from 620° F. to 680° F., from 620° F. to 660° F., from 620° F. to 640° F., from 640° F. to 700° F., from 640° F. to 680° F., from 640° F. to 660° F., from 660° F. to 700° F., from 660° F. to 680° F., or from 680° F. to 700° F. It is noted that unless specified otherwise, the temperatures discussed in relation to the various heat treatments described herein refer to the temperature of the atmosphere to which the base alloy may be exposed, or to which the furnace may be set; the base alloy itself may not necessarily reach these temperatures.

In terms of upper limits, the aging temperature may be less than 800° F., e.g., less than 700° F., less than 680° F., less than 660° F., less than 640° F., or less than 620° F. The inventors have found that if the cold worked alloy is aged below 600° F., the stress in the cold worked alloy may be relieved to some extent, but the desired strength may not be obtained. Thus, in terms of lower limits, the aging temperature may be at least 500° F., e.g., at least 550° F., at least 600° F., at least 620° F., at least 640° F., at least 660° F., or at least 680° F.

In some embodiments, the aging time, e.g., the time period for which the cold worked alloy may be exposed to any of the elevated temperature described above, may range from 1 minute to 10 minutes, e.g., from 1 minute to 5 minutes, from 1 minute to 4 minutes, from 1 minute to 3.5 minutes, from 1 minute to 3 minutes, from 1 minute to 2.5 minutes, from 1 minute to 2 minutes, from 2 minutes to 5 minutes, from 2 minutes to 4 minutes, from 2 minutes to 3.5 minutes, from 2 minutes to 3 minutes, from 2 minutes to 2.5 minutes, from 2.5 minutes to 5 minutes, from 2.5 minutes to 4 minutes, from 2.5 minutes to 3.5 minutes, from 2.5 minutes to 3 minutes, from 3 minutes to 5 minutes, from 3 minutes to 4 minutes, from 3 minutes to 3.5 minutes, from 3.5 minutes to 5 minutes, or from 3.5 minutes to 4 minutes. In terms of upper limits, the aging time may be less than 10 minutes, e.g., less than 8 minutes, less than 5 minutes, less than 4 minutes, less than 3.5 minutes, less than 3 minutes, less than 2.5 minutes, or less than 2 minutes. In terms of lower limits, the aging time may be at least 1 minute, e.g., at least 2 minutes, at least 2.5 minutes, at least 3 minutes, at least 3.5 minutes, or at least 4 minutes.

In some embodiments, the process advantageously employs lesser amounts of heat treating steps, as opposed to conventional processes, which require many heat treating steps. The additional heat treating steps detrimentally add complexity and resources to the overall process. For example, the process may employ fewer than 5 heat treating steps, e.g., fewer than 4, fewer than 3, or fewer than 2. In some cases, the process requires a single heat treating step.

Unexpectedly, by performing the cold working and heat treating operations at the specific conditions described herein, the resultant copper-beryllium alloy product not only demonstrates improved strength characteristics along the direction of cold working, but also demonstrates improved and/or even better strength characteristics in directions other than the direction of the cold working, as will be discussed in more detail below.

As mentioned above, the cold working of the base alloy may be considered a CRA-driven operation in that it is performed in order to achieve a predetermined percentage of CRA, although the final alloy product thickness may vary. To achieve a desired final alloy product thickness while maintaining the percentage of CRA for this final, CRA-driven cold working operation, the preparation of the base alloy may include a preliminary cold working operation to obtain the desired base alloy thickness. Thus, the preliminary cold working may be considered as a primarily thickness-driven operation in that it is performed to achieve a predetermined thickness, e.g., the desired base alloy thickness. The preliminary cold working may be omitted if the thickness of the incoming alloy is already at the desired base alloy thickness. In some cases, the base alloy thickness may be calculated according to the following formula:

$$T_{BA} = \frac{T_{FA}}{1 - \%\ CRA}$$

where $T_{BA}$ is the base alloy thickness, TFA is the final thickness of the processed alloy, and % CRA is the predetermined percentage of CRA to be achieved by the final, CRA-driven cold working.

Depending on the application, the desired final thickness of the processed copper-beryllium alloy product may range from 0.01 mm to 0.10 mm, e.g., from 0.01 mm to 0.08 mm, from 0.01 mm to 0.06 mm, from 0.01 mm to 0.04 mm, from 0.01 mm to 0.02 mm, from 0.02 mm to 0.10 mm, from 0.02 mm to 0.08 mm, from 0.02 mm to 0.06 mm, from 0.02 mm to 0.04 mm, from 0.04 mm to 0.10 mm, from 0.04 mm to 0.08 mm, from 0.04 mm to 0.06 mm. from 0.06 mm to 0.10 mm, from 0.06 mm to 0.08 mm, or from 0.08 mm to 0.10 mm. In terms of upper limits, the desired final thickness of the processed copper-beryllium alloy product may be less than 0.10 mm, less than 0.08 mm, less than 0.06 mm, less than 0.04 mm, or less than 0.02 mm. In terms of lower limits, the desired final thickness of the processed copper-beryllium alloy product may be greater than 0.01 mm, greater than 0.02 mm, greater than 0.04 mm, greater than 0.06 mm, or greater than 0.08 mm.

Preparation of the Base Alloy

Depending on the desired final thickness of the processed copper-beryllium alloy product and the predetermined percentage of CRA to be achieved by the final, CRA-driven cold working operation, the prepared base alloy thickness may range from 0.05 mm to 0.25 mm, e.g., from 0.05 mm to 0.20 mm, from 0.05 mm to 0.15 mm, from 0.05 mm to 0.10 mm, from 0.10 mm to 0.25 mm, from 0.10 mm to 0.20 mm, from 0.10 mm to 0.15 mm, from 0.15 mm to 0.25 mm, from 0.15 mm to 0.20 mm, or from 0.20 mm to 0.25 mm. In terms of upper limits, the base alloy thickness may be less than 0.25 mm, e.g., less than 0.20 mm, less than 0.15 mm, or less than 0.10 mm. In terms of lower limits, the base alloy thickness may be greater than 0.05 mm, e.g., greater than 0.10 mm, greater than 0.15 mm, or greater than 0.20.

Because, in some cases, the preliminary cold working is thickness-driven, the preliminary cold working may be performed to various percentages of CRA depending on the thickness of the incoming alloy which may be a copper-beryllium alloy sheet or plate. In some cases, the incoming alloy may be a copper-beryllium alloy sheet, and may have a thickness ranging from 0.1 mm to 2.0 mm, e.g., from 0.1 mm to less 1.5 mm, from 0.1 mm to 1.0 mm, from 0.1 mm to 0.5 mm, from 0.5 to 2.0 mm, from 0.5 to 1.5 mm, from 0.5 to 1.0 mm, from 1.0 mm to 2.0 mm, from 1.0 mm to 1.5 mm, or from 1.5 mm to 2.0 mm. In terms of upper limits, the incoming alloy may have a thickness of less than 2.0 mm, less than 1.5 mm, less than 1.0 mm, or less than 0.5 mm. In terms of lower limits, the incoming alloy may have a thickness of at least 0.1 mm, at least 0.5 mm, at least 1.0 mm, at least 1.5 mm, or at least 2.0 mm.

Depending on the thickness of the incoming alloy, the percentage of CRA performed by the preliminary cold working may range from 5% to 95%, e.g., from 5% to 75%, from 5% to 55%, from 5% to 35%, from 5% to 15%, from 15% to 95%, from 15% to 75%, from 15% to 55%, from 15% to 35%, from 35% to 95%, from 35% to 75%, from 35% to 55%, from 55% to 95%, from 55% to 75%, or from 75% to 95%. In terms of upper limits, the percentage of CRA performed by the preliminary cold working may be less than 95%, e.g., less than 75%, less than 55%, less than 35%, or less than 15%. In terms of lower limits, the percentage of CRA performed by the preliminary cold working may be at least 5%, e.g., at least 15%, at least 35%, at least 55%, or at least 75%.

In some cases, the preparation of the base alloy may further include one or more preliminary heat treating operations subsequent to the preliminary cold working. For example, the one or more preliminary heat treating operations may include solution annealing, followed by quenching or rapid cooling. The solution annealing may be performed by placing the base alloy in a furnace or other similar assembly and exposing the base alloy to an elevated temperature in the range of from 1350° F. to 1450° F. for a time period of from 0.5 minutes to 5 minutes. In some embodiments, the solution annealing may be performed, for example, by placing the base alloy in strip form on a conveyor furnace apparatus and running the alloy strip at an appropriate rate through the conveyor furnace. The quenching or rapid cooling may be achieved by air quenching, which may be performed by directing a stream of gas, such as air or an inert gas, towards the annealed base alloy.

In some embodiments, the annealing temperature, i.e., the elevated temperature to which the preliminarily cold worked alloy may be exposed during the solution annealing operation, may range from 1350° F. to 1450° F., e.g., from 1350° F. to 1425° F., from 1350° F. to 1400° F., from 1350° F. to 1375° F., from 1375° F. to 1450° F., from 1375° F. to 1425° F., from 1375° F. to 1400° F., from 1400° F. to 1450° F., from 1400° F. to 1425° F., or from 1425° F. to 1450° F. In terms of upper limits, the annealing temperature may be less than 1450° F. to limit the growth of the grains into much bigger size, which may hinder the subsequent cold working. For example, the annealing temperature may be less than 1425° F., less than 1400° F., or less than 1375° F. In terms of lower limits, the annealing temperature may be at least 1350° F. so as to solutionize the preliminarily cold worked alloy to allow beryllium to diffuse throughout the copper matrix. For example, the annealing temperature may be at least 1375° F., at least 1400° F., or at least 1425° F.

In some embodiments, the annealing time, i.e., the time period for which the preliminarily cold worked alloy may be exposed to any of the elevated temperature described herein, may range from 0.5 minutes to 5 minutes, e.g., from 0.5 minutes to 4 minutes, from 0.5 minutes to 3 minutes, from 0.5 minutes to 2 minutes, from 0.5 minutes to 1.5 minutes, from 0.5 minutes to 1 minute, from 1 minute to 5 minutes, from 1 minute to 4 minutes, from 1 minute to 3 minutes, from 1 minute to 2 minutes, from 1 minute to 1.5 minutes, from 1.5 minutes to 5 minutes, from 1.5 minutes to 4 minutes, from 1.5 minutes to 3 minutes, from 1.5 minutes to 2 minutes, from 2 minutes to 5 minutes, from 2 minutes to 4 minutes, from 2 minutes to 3 minutes, from 3 minutes to 5 minutes, from 3 minutes to 4 minutes, or from 4 minutes to 5 minutes. In terms of upper limits, the annealing period may be less than 5 minutes, e.g., less than 4 minutes, less than 3 minutes, less than 2 minutes, less than 1.5 minutes, or less than 1 minute. In terms of lower limits, the annealing period may be at least 0.5 minutes, e.g., at least 1 minute, at least 1.5 minutes, at least 2 minutes, at least 3 minutes, or at least 4 minutes.

In some embodiments, the one or more preliminary heat treating operations may further include an aging operation to restore at least some of the strength of the annealed and quenched alloy. In some embodiments, the aging of the annealed and quenched alloy may be performed by placing the annealed and quenched alloy in a furnace or other similar assembly and exposing the annealed and quenched alloy to an elevated temperature in the range of from 475° F. to 600° F. for a time period of from 1 hour to 5 hours. During the aging operation, beryllium-containing compound are formed as interstitial components or precipitates in the copper matrix to strengthen the alloy.

In some embodiments, the aging temperature, i.e., the elevated temperature to which the annealed and quenched alloy may be exposed during the aging operation, may range from 475° F. to 600° F., e.g., from 475° F. to 575° F., from 475° F. to 550° F., from 475° F. to 525° F., from 475° F. to 500° F., from 500° F. to 600° F., from 500° F. to 575° F., from 500° F. to 550° F., from 500° F. to 525° F., from 525° F. to 600° F., from 525° F. to 575° F., from 525° F. to 550° F., from 550° F. to 600° F., from 550° F. to 575° F., or from 575° F. to 600° F. In terms of upper limits, the aging temperature may be less than 600° F., e.g., less than 575° F., less than 550° F., less than 525° F., or less than 500° F. In terms of lower limits, the aging temperature may be at least 475° F., e.g., at least 500° F., at least 525° F., at least 550° F., or at least 575° F.

In some embodiments, the aging time, i.e., the time period for which the annealed and quenched alloy may be exposed to any of the elevated temperature described above, may range from 1 hour to 5 hours, e.g., from 1 hour to 4 hours, from 1 hour to 3.5 hours, from 1 hour to 3 hours, from 1 hour to 2.5 hours, from 1 hour to 2 hours, from 2 hours to 5 hours, from 2 hours to 4 hours, from 2 hours to 3.5 hours, from 2 hours to 3 hours, from 2 hours to 2.5 hours, from 2.5 hours to 5 hours, from 2.5 hours to 4 hours, from 2.5 hours to 3.5 hours, from 2.5 hours to 3 hours, from 3 hours to 5 hours, from 3 hours to 4 hours, from 3 hours to 3.5 hours, from 3.5 hours to 5 hours, from 3.5 hours to 4 hours, or from 4 hours to 5 hours. In terms of upper limits, the aging time may be less than 5 hours, e.g., less than 4 hours, less than 3.5 hours, less than 3 hours, less than 2.5 hours, or less than 2 hours. In terms of lower limits, the aging time may be at least 1 hour, e.g., at least 2 hours, at least 2.5 hours, at least 3 hours, at least 3.5 hours, at least 4 hours, or at least 5 hours.

In some embodiments, following the aging operation and prior to the final CRA-driven cold working, pickling may be performed to remove surface impurities or contaminants, and edge trimming may also be performed in some cases.

Performance Characteristics

The described alloy products demonstrate improved strength characteristics, e.g., fatigue strength, tensile strength, and yield strength. The fatigue strength is tested according to ASTM E796-94 (2004), and the tensile strength and yield strength are tested according to ASTM E8 (2016). Although not specifically described, the process described herein may improve other strength characteristics and/or other mechanical properties of the copper-beryllium alloy products as would be appreciated by one skilled in the art.

Fatigue Strength

The copper-beryllium alloy product may demonstrate improved fatigue strength, as measured along the direction of the cold working, at various amounts of testing cycles.

Specifically, the copper-beryllium alloy product processed by the operations described herein may demonstrate a fatigue strength from 385 MPa to 1000 MPA, e.g., from 385 MPa to 750 MPa, from 400 MPa to 750 MPa, from 400 MPa to 650 MPa, from 450 MPa to 650 MPa, from 450 MPa to 600 MPa, from 450 MPa to 550 MPa, from 450 MPa to 500 MPa, from 500 MPa to 650 MPa, from 500 MPa to 600 MPa, from 500 MPa to 550 MPa, from 550 MPa to 650 MPa, from 550 MPa to 600 MPa, or from 600 MPa to 650 MPa, after $10^6$ cycles of testing. In terms of lower limits, the processed copper-beryllium alloy product may demonstrate a fatigue strength of at least 385 MPa, e.g., at least 400 MPa, at least 450 MPa, at least 500 MPa, at least 550 MPa, at least 600 MPa, or at least 650 MPa, after $10^6$ cycles of testing.

Specifically, the copper-beryllium alloy product processed by the operations described herein may demonstrate a fatigue strength from 500 MPa to 1000 MPa, e.g., from 500 MPa to 750 MPA, from 550 MPa to 750 MPa, from 550 MPa to 700 MPa, from 500 MPa to 750 MPa, from 575 MPa to 725 MPa, from 600 MPa to 700 MPa, or from 625 MPa to 675 MPa, after $10^5$ cycles of testing. In terms of lower limits, the processed copper-beryllium alloy product may demonstrate a fatigue strength of at least 500 MPa, e.g., at least 550 MPa, at least 575 MPa, at least 600 MPa, or at least 625 MPa, after $10^5$ cycles of testing.

Specifically, the copper-beryllium alloy product processed by the operations described herein may demonstrate a fatigue strength from 700 MPa to 1100 MPa, e.g., from 900 MPa to 1100 MPa, from 925 MPa to 1075 MPa, from 950 MPa to 1050 MPa, or from 975 MPa to 1025 MPa, after $10^4$ cycles of testing. In terms of lower limits, the processed copper-beryllium alloy product may demonstrate a fatigue strength of at least 700 MPa, e.g., at least 750 MPa, at least 800 MPa, at least 850 MPa, at least 900 MPa, at least 925 MPa, at least 950 MPa, at least 975 MPa, or at least 990 MPa, after $10^4$ cycles of testing.

The fatigue strength of the processed alloy product may vary depending on the processing conditions, but will nevertheless demonstrate significant improvement(s) over conventional alloy products. For example, the fatigue strength may vary depending on the different percentages of CRA obtained by the final, CRA-driven cold working. Specifically, as the percentage of CRA achieved by the cold working gradually increases, the fatigue strength may also improve. For example, when the copper-beryllium alloy is cold worked to achieve 40% to 60% of CRA, upon completion of the subsequent heat treatment, the resultant alloy product may demonstrate a fatigue strength ranging from 385 MPa to 650 MPa, after $10^6$ cycles of testing. When the copper-beryllium alloy is cold worked to achieve 60% to 70% of CRA, upon completion of the subsequent heat treatment, the resultant alloy product may demonstrate a fatigue strength ranging from 450 MPa to 650 MPa, after $10^6$ cycles of testing. When the copper-beryllium alloy is cold worked to achieve 70% to 80% of CRA, upon completion of the subsequent heat treatment, the resultant alloy product may demonstrate a fatigue strength ranging from 500 MPa to 650 MPa, after $10^6$ cycles of testing. The other ranges listed herein may be utilized to characterize narrower ranges or higher lower limits.

Without being bound by theory, it is believed that the improved fatigue strength may be due to the alteration in the microstructure of the cold worked alloy. And the disclosed alloy products have such alterations, which are not present in conventional alloy products.

As the percentage of CRA gradually increases, the microstructure of the alloy product may be advantageously altered to minimize fatigue crack initiation sites and thus improve the fatigue performance of the copper-beryllium alloy product. Fatigue crack initiation sites may generally refer to sites at which a fatigue crack may start. Without being bound by theory, it is postulated that, in the disclosed alloy products, the grain structure is elongated. And the elongated grains provide significantly fewer surface grain boundaries, which beneficially reduces the number of potential (fatigue) crack initiation sites. Further, grain boundaries oriented along the plane of principle shear stress (45° relative to the surface) provide easy slip planes for fatigue crack initiation. Such configurations are prevalent in equiaxed grains (such as those in conventional alloys), but virtually nonexistent in elongated grains (such as those in the disclosed alloy products). These microstructure differences, alone or in combination with one another, have been found to advantageously contribute to the aforementioned improvements in fatigue strength (and to improvements in other strength characteristics).

It is postulated that the disclosed alloy products have improved resistance to (fatigue) crack propagation, e.g., due to the aforementioned processing steps and the effects thereof on the microstructure. In some cases, it is believed that the cold working step reduces the number of fatigue crack initiation sites. That is, fatigue initiation sites in the cold worked alloy upon completion of the final cold working may be less than the fatigue initiation sites immediately prior to the final cold working by 1% to 35%, e.g., 2% to 30%, 3% to 25%, 5% to 25%, 5% to 20%, 5% to 15%, or 5% to 10%, depending on the percentage of CRA performed.

FIGS. 2A-2D show the microstructures, along the direction of the cold working, of various copper-beryllium alloy products produced using the process described herein. The alloy products are cold worked to different percentages of CRA. Specifically, the alloy product shown in FIG. 2A has been cold worked to 40% of CRA, the alloy product shown in FIG. 2B has been cold worked to 58% of CRA, the alloy product shown in FIG. 2C has been cold worked to 70% of CRA, and the alloy product shown in FIG. 2D has been cold worked to 75% of CRA.

Figures 2A, 2B, 2C, 2D:
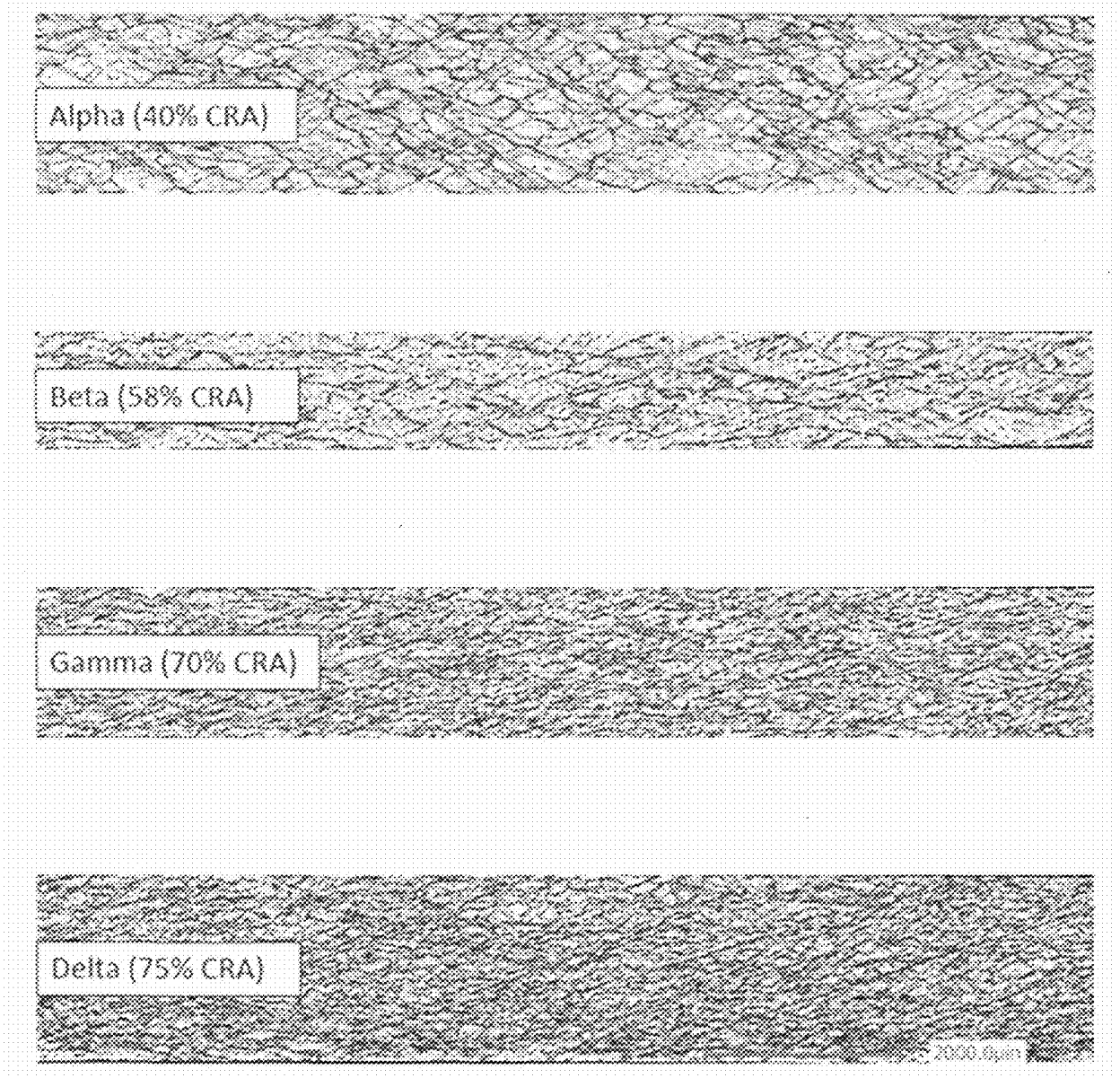
FIGS. 2A-2D show the microstructures of exemplary processed copper-beryllium alloy products.

When the alloy is cold worked to 40% or less of CRA, the grain structure may (detrimentally) be generally uniform and equiaxed, and may generally have a common or uniform orientation angle of about or close to ±45° (or simply 45°, relative to the rolled upper and lower surfaces of the alloy), such as shown in FIG. 2A. As the percentage of CRA gradually increases, the grain structure becomes non-equiaxed and less uniform or more non-uniform. As a result, the aforementioned benefits of elongated grain structures and/or non-equiaxed grains are advantageously achieved. For example, the grains become elongated, flattened, and/or compressed, and the orientation angle of the grain structure gradually decreases. In some cases, as the percentage of CRA gradually increases, the orientation angle of the grain structure may be reduced to less than 40°, less than 35°, less than 30°, less than 25°, less than 20°, less than 15°, less than 10°, or close to 0° relative to the rolled surfaces of the alloy. Additionally, as the percentage of CRA gradually increases, the commonality of or uniformity in the grain structure, such as the grain structure orientation, becomes less prominent. For example, by comparing the grain structure orientation shown in FIG. 2A (worked to 40% of CRA) and the grain structure orientation shown in FIG. 2B (worked to 58% of CRA), it can be seen that, in addition to reduced grain structure orientation angle, the grain structure orientation shown in FIG. 2B also becomes less uniform or non-uniform. As the percentage of CRA continues to increase, a common or uniform grain structure orientation, such as the 45° grain structure orientation, is no longer observed, such as shown in FIGS. 2C and 2D. These microstructure improvements have been found to contribute, at least in part, to the aforementioned improvements in performance characteristics.

Importantly, it has been found that grain orientation may contribute significantly to the aforementioned improvements in strength characteristics. Thus, the unexpected grain orientation of the disclosed alloy products has been found to be particularly beneficial.

As noted above, it is believed that a common or uniform orientation angle of the grain structure, such as the 45° orientation shown in FIG. 2A, tends to detrimentally increase the risk of or opportunity for fatigue failure because they provide for easy slip planes for fatigue crack initiation. The inventors have found that by increasing the percentage of CRA to at least decrease the grain structure orientation from 45° to a lesser degree, the risk or opportunity for fatigue failure may be reduced. By further increasing the percentage of CRA to reduce the commonality of or uniformity in the grain structure orientation, the risk of or opportunity for easy slip planes and fatigue failure can be further reduced or eliminated, and superior fatigue strength over conventional copper-beryllium alloy product can be obtained.

As mentioned above, as the percentage of CRA gradually increases, the grains become further elongated along the direction of the cold working, and the thickness of the grains become reduced as the thickness of the alloy is reduced by the cold working.

In some embodiments, the grains of the cold-worked alloy generally have a high aspect ratio. The aspect ratio of the grains may be defined as the ratio of the length of the grains to the thickness of the grains. The length may be measured along the direction of the cold working, and the width may be measured along the thickness dimension of the cold worked alloy. Thus, the length of the grains of the cold worked alloy is generally greater than the thickness of the grains. The cold worked alloy, as well as the subsequently heat treated alloy, e.g., the copper-beryllium alloy product produced, may generally have an aspect ratio of the grains greater than 1:1, e.g., greater than 2:1, greater than 3:1, greater than 4:1, greater than 5:1, greater than 6:1, greater than 7:1, greater than 8:1, or greater than 9:1. In terms of ranges, the length-to-thickness aspect ratio of the elongated grains of the alloy products disclosed herein may range from 1:1 to 11:1, e.g., from 2:1 to 10:1, from 2:1 to 9:1, from 4:1 to 9:1, from 5:1 to 8:1, from 6:1 to 9:1, from 6:1 to 8:1, or from 7:1 to 8:1.

For example, when the alloy is cold worked to greater than 40%, e.g., from 40% to 60%, of CRA, the aspect ratio of the grains may be range from 4:1 to 6:1, and may be greater than 4:1 or greater than 5:1. When the alloy is cold worked to greater than 60%, e.g., from 60% to 70%, of CRA, the aspect ratio of the grains may be range from 6:1 to 7:1, and may be greater than 6:1. When the alloy is cold worked to greater than 70%, e.g., from 70% to 80% of CRA, the aspect ratio of the grains may be range from 7:1 to 9:1, e.g., from 7:1 to 8:1, or from 8:1 to 9:1, and may be greater than 7:1, or greater than 8:1.

As the percentage of CRA gradually increases and the grains become more elongated, flattened, and/or compressed, the fatigue strength generally increases. However, there may be an upper limit in terms of desired amount of CRA. Without being bound by theory, it is postulated that too much CRA may result in a copper-beryllium alloy product that may be brittle, which may result in an undesirable alloy product.

Further, it has been observed that when the CRA-driven cold working is performed to achieve higher levels of CRA reduction, e.g., greater than 70% or from 70% to 80%, a significant improvement in the fatigue strength can be consistently obtained. For example, when the cold working is performed to achieve at least 70% of CRA, copper-beryllium alloy products demonstrating a fatigue strength ranging from 500 MPa to 650 MPa, e.g., 500 MPa to 600 MPa, from 500 MPa to 550 MPa, from 550 MPa to 650 MPa, from 550 MPa to 600 MPa, or from 600 MPa to 650 MPa, after $10^6$ cycles of testing, can be consistently produced. In terms of lower limits, when the cold working is performed to achieve at least 70% of CRA or from 70% to 80%, the fatigue strength of the copper-beryllium alloy product described herein may be at least 500 MPa, at least 550 MPa, at least 600 MPa, or at least 650 MPa.

It is noted that the values of the fatigue strength discussed herein refer to the values of the fatigue strength possessed by the alloy product after further heat treatment following the cold working. The fatigue strength may be slightly reduced by the heat treatment following the cold working. Nonetheless, the heat treatment following the cold working is still desired because the heat treatment further increases the tensile strength and the yield strength as discussed below, and reduces the brittleness of the cold rolled alloy. Thus, the cold working and the heat treating operations of the process described herein balance the improvement in fatigue strength, tensile strength, and/or yield strength so as to achieve overall optimal strength characteristics of the alloy product.

It is further noted that the values of the fatigue strength discussed herein are measured along the direction of cold working. It is postulated that the copper-beryllium alloy product described herein surprisingly also possess improved fatigue strength when measured in other directions, e.g., in the direction transverse to the cold working, or any direction between the direction of the cold working and the direction transverse to the cold working.

Tensile Strength and Yield Strength

In addition to the improvement in the fatigue strength, the process described herein further improve the (ultimate) tensile strength and the yield strength of the copper-beryllium alloy products.

Generally, the preparation steps, e.g., preliminary cold working and/or preliminary heat treating prior to the CRA-driven cold working that result in the percentage of CRA greater than 40%, are those that form the base alloy. The CRA-driven cold working and the subsequent heat treating operations process the base alloy to produce the final copper-beryllium alloy product that demonstrate superior strength characteristics over conventional copper-beryllium alloys. The tensile strength and the yield strength will be discussed by comparing the strength characteristics of the base alloy and the strength characteristics of the further processed alloy product resulting from completion of the cold working and heat treating steps.

In terms of tensile strength, the base alloy may demonstrate an ultimate tensile strength ranging from 165 ksi to 185 ksi, e.g., from 165 ksi to 180 ksi, from 165 ksi to 175 ksi, from 165 ksi to 170 ksi, 170 ksi to 185 ksi, from 170 ksi to 180 ksi, from 170 ksi to 175 ksi, from 175 ksi to 185 ksi, from 175 ksi to 180 ksi, or from 180 ksi to 185 ksi. In terms of lower limits, the base alloy may demonstrate an ultimate tensile strength of at least 165 ksi, e.g., at least 170 ksi, at least 175 ksi, or at least 180 ksi. In terms of upper limits, the base alloy may demonstrate an ultimate tensile strength of less than 185 ksi, e.g., less than 180 ksi, less than 175 ksi, or less than 170 ksi.

In terms of yield strength, the base alloy may demonstrate a 0.2% offset yield strength ranging from 135 ksi to 160 ksi, e.g., from 135 ksi to 155 ksi, from 135 ksi to 150 ksi, from 135 ksi to 145 ksi, from 135 ksi to 140 ksi, from 140 ksi to 160 ksi, from 140 ksi to 155 ksi, from 140 ksi to 150 ksi, from 140 ksi to 145 ksi, from 145 ksi to 160 ksi, from 145 ksi to 155 ksi, from 145 ksi to 150 ksi, from 150 ksi to 160 ksi, from 150 ksi to 155 ksi, or from 155 ksi to 160 ksi. In terms of lower limits, the base alloy may demonstrate a 0.2% offset yield strength of at least 135 ksi, e.g., at least 140 ksi, at least 145 ksi, at least 150 ksi, or at least 155 ksi. In terms of upper limits, the base alloy may demonstrate a 0.2% offset yield strength of less than 160 ksi, e.g., less than 155 ksi, less than 150 ksi, less than 145 ksi, or less than 140 ksi.

Upon completion of the CRA-driven cold working, the cold worked alloy may achieve an ultimate tensile strength ranging from 200 ksi to 215 ksi, e.g., from 200 ksi to 210 ksi, from 200 ksi to 205 ksi, from 205 ksi to 215 ksi, from 205 ksi to 210 ksi, or from 210 ksi to 215 ksi. In terms of lower limits, upon completion of the CRA-driven cold working, the cold worked alloy may achieve an ultimate tensile strength of at least 200 ksi, e.g., at least 205 ksi, or at least 210 ksi.

Upon completion of the CRA-driven cold working, the cold worked alloy may achieve a 0.2% offset yield strength ranging from 180 ksi to 200 ksi, e.g., from 180 ksi to 195 ksi, from 180 ksi to 190 ksi, from 180 ksi to 185 ksi, from 185 ksi to 200 ksi, from 185 ksi to 195 ksi, from 185 ksi to 190 ksi, from 190 ksi to 200 ksi, from 190 ksi to 195 ksi, or from 195 ksi to 200 ksi. In terms of lower limits, upon completion of the CRA-driven cold working, the cold worked alloy may achieve a 0.2% offset yield strength of at least 180 ksi, e.g., at least 185 ksi, at least 190 ksi, or at least 195 ksi.

By comparing the ultimate tensile strength immediately prior to the CRA-driven cold working (i.e., the ultimate tensile strength of the base alloy) and the ultimate tensile strength achieved upon completion of the CRA-driven cold working (i.e., the ultimate tensile strength of the cold worked alloy), the tensile strength increase by the CRA-driven cold working can be calculated. In some cases, the tensile strength may be increased by the CRA-driven cold working by at least 10%, e.g., at least 15%, at least 20%, at least 25%, or at least 30%. In terms of ranges, the tensile strength may be increased by the CRA-driven cold working by 10% to 30%, e.g., 10% to 25%, 10% to 20%, 10% to 15%, 15% to 30%, 15% to 25%, 15% to 20%, 20% to 30%, 20% to 25%, or 25% to 30%.

By comparing the 0.2% offset yield strength immediately prior to the CRA-driven cold working (i.e., the 0.2% offset yield strength of the base alloy) and the 0.2% offset yield strength achieved upon completion of the CRA-driven cold working (i.e., the 0.2% offset yield strength of the cold worked alloy), the yield strength increase by the CRA-driven cold working can be calculated. In some cases, the yield strength may be increased by the CRA-driven cold working by at least 20%, e.g., at least 25%, at least 30%, at least 35%, or at least 40%. In terms of ranges, the yield strength may be increased by the CRA-driven cold working by 20% to 40%, e.g., 20% to 35%, 20% to 30%, 20% to 25%, 25% to 40%, 25% to 35%, 25% to 30%, 30% to 40%, 30% to 35%, or 35% to 40%.

The tensile strength and/or the yield strength may be further improved upon completion of the subsequent heat treating, which produces the copper-beryllium alloy product that demonstrates strength characteristics superior to conventional copper-beryllium alloys. For example, upon completion of the heat treating, the cold worked and heat treated alloy, i.e., the copper-beryllium alloy product, may achieve an ultimate tensile strength (as measured along the direct of cold working or the longitudinal direction) ranging from 205 ksi to 245 ksi, e.g., from 210 ksi to 245 ksi, from 215 ksi to 245 ksi, from 215 ksi to 240 ksi, from 215 ksi to 235 ksi, from 215 ksi to 230 ksi, from 215 ksi to 225 ksi, from 215 ksi to 220 ksi, from 220 ksi to 245 ksi, from 220 ksi to 240 ksi, from 220 ksi to 235 ksi, from 220 ksi to 230 ksi, from 220 ksi to 225 ksi, from 225 ksi to 245 ksi, from 225 ksi to 240 ksi, from 225 ksi to 235 ksi, from 225 ksi to 230 ksi, from 230 ksi to 245 ksi, from 230 ksi to 240 ksi, from 230 ksi to 235 ksi, from 235 ksi to 245 ksi, from 235 ksi to 240 ksi, or from 240 ksi to 245 ksi. In terms of lower limits, upon completion of the heat treating, the copper-beryllium alloy product may achieve an ultimate tensile strength of at least 205 ksi, e.g., at least 210 ksi, at least 215 ksi, at least 220 ksi, at least 225 ksi, at least 230 ksi, at least 235 ksi, at least 240 ksi, or at least 245 ksi.

Upon completion of the heat treating, the copper-beryllium alloy product may achieve a 0.2% offset yield strength (in the longitudinal direction) ranging from 200 ksi to 230 ksi, e.g., from 205 ksi to 230 ksi, from 205 ksi to 225 ksi, from 205 ksi to 220 ksi, from 205 ksi to 215 ksi, from 205 ksi to 210 ksi, from 210 ksi to 230 ksi, from 210 ksi to 225 ksi, from 210 ksi to 220 ksi, from 210 ksi to 215 ksi, from 215 ksi to 230 ksi, from 215 ksi to 225 ksi, from 215 ksi to 220 ksi, from 220 ksi to 230 ksi, from 220 ksi to 225 ksi, from 220 ksi to 230 ksi, from 220 ksi to 225 ksi, or from 225 ksi to 230 ksi. In terms of lower limits, upon completion of the heat treating, the copper-beryllium alloy product may achieve a 0.2% offset yield strength of at least 200 ksi, e.g., at least 205 ksi, at least 210 ksi, at least 215 ksi, at least 220 ksi, at least 225 ksi, or at least 230 ksi.

By comparing the ultimate tensile strength immediately prior to the heat treating (i.e., the ultimate tensile strength of the cold worked alloy) and the ultimate tensile strength achieved upon completion of the heat treating (i.e., the ultimate tensile strength of the copper-beryllium alloy product), the tensile strength increase by the heat treating can be calculated. In some cases, the tensile strength may be increased by the heat treating by at least 5%, e.g., at least 10%, at least 15%, or at least 20%. In terms of ranges, the tensile strength may be increased by the heat treating by 5% to 20%, e.g., 5% to 15%, 5% to 10%, 10% to 20%, 10% to 15%, or 15% to 20%.

By comparing the 0.2% offset yield strength immediately prior to the heat treating (i.e., the 0.2% offset yield strength of the cold treated alloy) and the 0.2% offset yield strength achieved upon completion of the heat treating (i.e., the 0.2% offset yield strength of the copper-beryllium alloy product), the yield strength increase by the heat treating can be calculated. In some embodiments, the yield strength may be increased by the heat treating by at least 5%, e.g., at least 10%, at least 15%, or at least 20%. In terms of ranges, the yield strength may be increased by the heat treating by 5% to 20%, e.g., 5% to 15%, 5% to 10%, 10% to 20%, 10% to 15%, or 15% to 20%.

By comparing the ultimate tensile strength immediately prior to the CRA-driven cold working (i.e., the ultimate tensile strength of the base alloy) and the ultimate tensile strength achieved upon completion of the heat treating (i.e., the ultimate tensile strength of the copper-beryllium alloy product), the tensile strength increase by performing both the cold working and heat treating operations can be calculated. In some cases, by performing both the cold working and heat treating operations, the tensile strength of the base alloy may be increased by at least 15%, e.g., at least 20%, at least 25%, at least 30%, at least 35%, at least 40%, at least 45%, or at least 50%. In terms of ranges, the tensile strength of the base alloy may be increased by performing both the cold working and heat treating operations by 15% to 50%, e.g., 15% to 45%, 15% to 40%, 15% to 35%, 15% to 30%, 15% to 25%, 15% to 20%, 20% to 50%, 20% to 45%, 20% to 40%, 20% to 35%, 20% to 30%, 20% to 25%, 25% to 50%, 25% to 45%, 25% to 40%, 25% to 35%, 25% to 30%, 30% to 50%, 30% to 45%, 30% to 40%, 30% to 35%, 35% to 50%, 35% to 45%, 35% to 40%, 40% to 50%, 40% to 45%, or 45% to 50%.

By comparing the 0.2% offset yield strength immediately prior to the CRA-driven cold working (i.e., the 0.2% offset yield strength of the base alloy) and the 0.2% offset yield strength achieved upon completion of the heat treating (i.e., the 0.2% offset yield strength of the copper-beryllium alloy product), the yield strength increase by performing both the cold working and heat treating operations can be calculated. In some cases, by performing both the cold working and heat treating operations, the yield strength of the base alloy may be increased by at least 25%, e.g., at least 30%, at least 35%, at least 40%, at least 45%, at least 50%, at least 55%, at least 60%, at least 65%, or at least 70%. In terms of ranges, the yield strength of the base alloy may be increased by performing both the cold working and heat treating operations by 25% to 70%, e.g., 25% to 65%, 25% to 60%, 25% to 55%, 25% to 50%, 25% to 45%, 25% to 40%, 25% to 35%, 25% to 30%, 30% to 70%, 30% to 65%, 30% to 60%, 30% to 55%, 30% to 50%, 30% to 45%, 30% to 40%, 30% to 35%, 35% to 70%, 35% to 65%, 35% to 60%, 35% to 55%, 35% to 50%, 35% to 45%, 35% to 40%, 40% to 70%, 40% to 65%, 40% to 60%, 40% to 55%, 40% to 50%, 40% to 45%, 45% to 70%, 45% to 65%, 45% to 60%, 45% to 55%, 45% to 50%, 50% to 70%, 50% to 65%, 50% to 60%, 50% to 55%, 55% to 70%, 55% to 65%, 55% to 60%, 60% to 70%, 60% to 65%, or 65% to 70%.

Further, the alloy product produced using the process described herein not only achieves improved strength characteristics along the direction of the cold working, but also unexpectedly demonstrates improved and/or even better strength characteristics in other directions. The direction of the cold working refers to the direction along which the base alloy is cold worked, e.g., by rolling, or the direction along which the grains are elongated. The direction of the cold working corresponds to the length of the cold worked alloy and the length of the produced copper-beryllium alloy product. Thus, the direction of the cold working may also be referred to as the longitudinal direction. A transverse direction is used herein to describe the direction corresponding to the width of the cold worked alloy and the width of the produced copper-beryllium alloy product, and the transverse direction is transverse to or perpendicular to the longitudinal direction or the direction of the cold working. Other directions between the transverse direction and the longitudinal direction may be referred to by using a degree of angle from the longitudinal direction. For example, a 30° direction refers to the direction that is rotated by 30° from the longitudinal direction (and thus rotated by 60° from the transverse direction), and a 45° direction refers to the direction that is rotated by 45° from the longitudinal or the transverse direction.

It has been found that the process described herein consistently produces copper-beryllium alloy products that have an ultimate tensile strength, along the direction of the cold working, greater than 200 ksi, e.g., greater than 205 ksi, greater than 210 ksi, greater than 215 ksi, greater than 220 ksi, greater than 225 ksi, greater than 230 ksi, greater than 235 ksi, greater than 240 ksi, or greater. The process described herein also consistently produces copper-beryllium alloy products that have a 0.2% offset yield strength, along the direction of the cold working, greater than 200 ksi, e.g., greater than 205 ksi, greater than 210 ksi, greater than 215 ksi, greater than 220 ksi, greater than 225 ksi, or greater.

Surprisingly, the process described herein also consistently produces copper-beryllium alloy products that have improved or even better strength characteristics in directions other that the direction of the cold working. This is unexpected because as discussed above that conventional copper-beryllium alloy products produced using conventional processes generally have decreased or inferior strength characteristics in direction other than the direction of the cold working. For example, for copper-beryllium alloy products processed using many of the conventional methods, the tensile strength in the transverse direction is typically 5% to 10% less than the tensile strength in the direction of the cold working, and similarly, the yield strength in the transverse direction is typically 5% to 10% less than yield strength in the direction of the cold working.

In contrast, the process described herein consistently produces copper-beryllium alloy products that have comparable or further improved strength characteristics in directions other than the direction of the cold working. For example, the copper-beryllium alloy products produced using the process described herein have strength characteristics along the 45° direction that are comparable or similar to the strength characteristics along the direction of the cold working, and have strength characteristics along the transverse direction that are better than the strength characteristics along the direction of the cold working.

For example, it has been found that the process described herein consistently produces copper-beryllium alloy products that have an ultimate tensile strength, along the 45° direction, of greater than 200 ksi, e.g., greater than 205 ksi, greater than 210 ksi, greater than 215 ksi, greater than 220 ksi, greater than 225 ksi, greater than 230 ksi, greater than 235 ksi, greater than 240 ksi, or greater, or greater. The process described herein also consistently produces copper-beryllium alloy products that have a 0.2% offset yield strength, along the 45° direction, of greater than 200 ksi, e.g., greater than 205 ksi, greater than 210 ksi, greater than 215 ksi, greater than 220 ksi, greater than 225 ksi, or greater.

Further, it has been found that the process described herein consistently produces copper-beryllium alloy products that have an ultimate tensile strength, along the transverse direction, of greater than 215 ksi, e.g., greater than 220 ksi, greater than 225 ksi, greater than 230 ksi, greater than 235 ksi, greater than 240 ksi, greater than 245 ksi, or greater. The process described herein also consistently produces copper-beryllium alloy products that have a 0.2% offset yield strength, along the transverse direction, of greater than 200 ksi, e.g., greater than 205 ksi, greater than 210 ksi, greater than 215 ksi, greater than 220 ksi, greater than 225 ksi, greater than 230 ksi, or greater.

Depending on the processing conditions, the tensile strength in the transverse direction may be greater than the tensile strength in the direction of the cold working by at least 5%, e.g., at least 6%, at least 7%, at least 8%, at least 9%, or at least 10%, as calculated by comparing the ultimate tensile strength in the transverse direction to the ultimate tensile strength in the direction of the cold working. In terms of ranges, the tensile strength in the transverse direction may be greater than the tensile strength in the direction of the cold working by from 5% to 10%, e.g., from 5% to 9%, from 5% to 8%, from 5% to 7%, from 5% to 6%, from 6% to 10%, from 6% to 9%, from 6% to 8%, from 6% to 7%, from 7% to 10%, from 7% to 9%, from 7% to 8%, from 8% to 10%, from 8% to 9%, or from 9% to 10%. In terms of upper limits, tensile strength in the transverse direction may be greater than the tensile strength in the direction of the cold working by less than 10%, less than 9%, less than 8%, less than 7%, or less than 6%.

Similarly, the yield strength in the transverse direction may be greater than the yield strength in the direction of the cold working by at least 5%, e.g., at least 6%, at least 7%, at least 8%, at least 9%, or at least 10%, as calculated by comparing the 0.2% offset yield strength in the transverse direction to the 0.2% offset yield strength in the direction of the cold working. In terms of ranges, the yield strength in the transverse direction may be greater than the yield strength in the direction of the cold working by from 5% to 10%, e.g., from 5% to 9%, from 5% to 8%, from 5% to 7%, from 5% to 6%, from 6% to 10%, from 6% to 9%, from 6% to 8%, from 6% to 7%, from 7% to 10%, from 7% to 9%, from 7% to 8%, from 8% to 10%, from 8% to 9%, or from 9% to 10%. In terms of upper limits, yield strength in the transverse direction may be greater than the yield strength in the direction of the cold working by less than 10%, less than 9%, less than 8%, less than 7%, or less than 6%.

Without being bound by theory, the comparable or improved strength characteristics in the directions other than the direction of cold working may be due to the aforementioned elongated grain structure and orientation angles.

By producing copper-beryllium alloy products having comparable or further improved strength characteristics in directions other than the direction of the cold working, the process described herein and the copper-beryllium alloy products produced thereby allow for greater flexibility in downstream processing, such as fitting or orienting the copper-beryllium alloy products in strip form inside other devices, e.g., a consumer mobile device.

The copper-beryllium alloy product described herein is generally processed into strips that satisfy one or more of the following standards as set by ASTM International, SAE (Society of Automotive Engineers) International, RWMA (regional wall motion abnormalities), European Standard EN, the Japanese Industrial Standard and the Military Standard, and the like, including but not limited to, ASTM B194, AMS 4530, AMS 4532, SAE J461, SAE J463, EN 1654, EN 13148, EN 14436, JIS H3130, QQC-533, etc.

EXAMPLES

The following examples are provided to illustrate the alloys and processes of the present disclosure. The examples are merely illustrative and are not intended to limit the disclosure to the materials, conditions, or process parameters set forth therein.

Examples 1-4 & Comparative Examples A-C

Examples 1-4 were prepared using the process described herein. A copper-beryllium alloy sheet comprising the following components was utilized: from 96.3 wt % to 99.5 wt % copper, from 0.15 wt % to 2 wt % beryllium, from 0 wt % to 2.7 wt % cobalt, from 0 wt % to 2.2 wt % nickel, and from 0 wt % to 0.5 wt % zirconium.

Step 1: A copper-beryllium base alloy was prepared by (i) preliminarily cold working the alloy sheet to a thickness about 4 times the desired final thickness; and (ii) heat treating the preliminarily cold worked alloy. The heat treatment included (a) solution annealing at 1390° F. for 0.83 minutes, followed by air quench; and (b) bulk aging at 545° F. for 3 hours. The copper-beryllium base alloy included uniform, equiaxed grains, and the orientation angles of the grains (e.g., orientation of grain boundaries) was about 45° relative to the preliminarily cold worked surfaces.

Step 2: The copper-beryllium base alloy was cold worked by cold rolling to achieve 74% to 75% of CRA thus yielding a cold worked alloy. The cold worked alloy included flattened, elongated grains. The orientation angle of the grains was close to 0° relative to the cold worked surfaces.

Step 3: The cold worked alloy was then heat treated to produce copper-beryllium alloy products (Examples 1-4). The heat treatment was performed via strand aging at 600° F. for 2.88 minutes such that the strength characteristics of the cold worked alloy was further improved via precipitation hardening. The flattened, elongated grain structure and the about 0° orientation angle of the grains were substantially maintained after strand aging. Representative grain structures for Examples 1-4 are shown in FIG. 2D.

Comparative Examples A, B, and C were prepared as follows. A copper-nickel-tin alloy sheet comprising the following components was utilized to produce Comparative Examples A-C: from 14.5 wt % to 15.5 wt % nickel, from 7.5 wt % to 8.5 wt % tin, 0.5 wt % or less iron, 0.5 wt % or less zinc, and the balance copper.

The preparation of the Comparative Examples required more process steps, e.g., more cold working and/or heat treating, than the preparation of the working Examples 1-4.

Step 1: A copper-nickel-tin base alloy was prepared by (i) preliminarily cold working the alloy sheet; and (ii) solution annealing at 1475° F. for 0.65 minutes, followed by air quench. The copper-nickel-tin base alloy included uniform, equiaxed grains, and the orientation angles of the grains (e.g., orientation of grain boundaries) was about 45° relative to the preliminarily cold worked surfaces.

Step 2: The copper-nickel-tin base alloy was cold worked by cold rolling to achieve about 40% to 45% of CRA thus yielding a cold worked alloy.

Step 3: The cold worked alloy was bulk aged at 645° F. to 660° F. for 2 hours to produce a bulk aged alloy.

Step 4: The bulk aged alloy was then further cold worked to achieve about 40% to 45% of CRA to produce a further cold worked alloy. Thus, through the two cold working steps, a total of about 65% to 70% of CRA was achieved from the copper-nickel-tin base alloy to the further cold worked alloy. The further cold worked alloy did not include flattened or elongated grains. Rather, the grains were coarse and not flattened. The orientation angle of the grains was greater than 30° relative to the cold worked surfaces, and some gains maintained close to 45° orientation angle.

Step 5: The further cold worked alloy was then heat treated to produce copper-nickel-tin alloy products (Comparative Example A-C). The heat treatment was performed via strand aging at 675° F. for 2.9 to 3.6 minutes. The grain structure and the orientation angle of the grains of the further cold worked alloy were substantially maintained after strand aging.

Examples 1-4 and Comparative Examples A-C were tested for ultimate tensile strength (UTS), 0.2% offset yield strength (YS), and percentage of elongation at break (% E) in accordance with ASTM E8 (2016).

Tables 1-3 below list ultimate tensile strength (UTS), 0.2% offset yield strength (YS), and percentage of elongation at break (% E) for Examples 1-4.

TABLE 1

Select strength characteristics measured in the longitudinal direction

| ID. | CRA | Final Thickness | UTS | YS | % E |
|---|---|---|---|---|---|
| Ex. #1 | 75% | 0.00197" (0.05 mm) | 225 ksi (1550 MPa) | 214 ksi (1474 MPa) | 1.8 |
| Ex. #2 | 74% | 0.00197" (0.05 mm) | 226 ksi (1557 MPa) | 214 ksi (1474 MPa) | 2.0 |
| Ex. #3 | 75% | 0.00157" (0.04 mm) | 227 ksi (1564 MPa) | 217 ksi (1495 MPa) | 2.0 |
| Ex. #4 | 74% | 0.00118" (0.03 mm) | 227 ksi (1564 MPa) | 216 ksi (1488 MPa) | 2.0 |

TABLE 2

Select strength characteristics measured in the transverse direction

| ID. | CRA | Final Thickness | UTS | YS | % E |
|---|---|---|---|---|---|
| Ex. #1 | 75% | 0.00197" (0.05 mm) | 236 ksi (1626 MPa) | 221 ksi (1523 MPa) | 2.0 |
| Ex. #2 | 74% | 0.00197" (0.05 mm) | 240 ksi (1654 MPa) | 225 ksi (1550 MPa) | 1.9 |
| Ex. #3 | 75% | 0.00157" (0.04 mm) | 239 ksi (1647 MPa) | 225 ksi (1550 MPa) | 1.9 |
| Ex. #4 | 74% | 0.00118" (0.03 mm) | 239 ksi (1647 MPa) | 225 ksi (1550 MPa) | 1.9 |

TABLE 3

Select strength characteristics measured in the 45° direction

| ID. | CRA | Final Thickness | UTS | YS | % E |
|---|---|---|---|---|---|
| Ex. #1 | 75% | 0.00197" (0.05 mm) | 226 ksi (1557 MPa) | 210 ksi (1447 MPa) | 2.2 |
| Ex. #2 | 74% | 0.00197" (0.05 mm) | 229 ksi (1578 MPa) | 213 ksi (1468 MPa) | 2.0 |
| Ex. #3 | 75% | 0.00157" (0.04 mm) | 228 ksi (1571 MPa) | 212 ksi (1461 MPa) | 2.1 |
| Ex. #4 | 74% | 0.00118" (0.03 mm) | 228 ksi (1571 MPa) | 215 ksi (1481 MPa) | 1.9 |

Tables 4-6 below list ultimate tensile strength (UTS), 0.2% offset yield strength (YS), and percentage of elongation at break (% E) for Comparative Examples A-C. As noted above, Comparative Examples A-C were prepared by a conventional method that involved more cold working and/or heat treatment steps.

TABLE 4

Select strength characteristics measured in the longitudinal direction

| ID. | CRA | Final Thickness | UTS | YS | % E |
|---|---|---|---|---|---|
| Comp. Ex. A | 68% | 0.00108" (0.0275 mm) | 203 ksi (1399 MPa) | 199 ksi (1371 MPa) | 1.6 |
| Comp. Ex. B | 65% | 0.00118" (0.03 mm) | 204 ksi (1406 MPa) | 199 ksi (1371 MPa) | 1.7 |
| Comp. Ex. C | 65% | 0.00157" (0.04 mm) | 204 ksi (1406 MPa) | 198 ksi (1364 MPa) | 1.7 |

TABLE 5

Select strength characteristics measured in the transverse direction

| ID. | CRA | Final Thickness | UTS | YS | % E |
|---|---|---|---|---|---|
| Comp. Ex. A | 68% | 0.00108" (0.0275 mm) | 212 ksi (1461 MPa) | 192 ksi (1323 MPa) | 2.2 |
| Comp. Ex. B | 65% | 0.00118" (0.03 mm) | 208 ksi (1433 MPa) | 188 ksi (1295 MPa) | 2.4 |
| Comp. Ex. C | 65% | 0.00157" (0.04 mm) | 214 ksi (1474 MPa) | 199 ksi (1371 MPa) | 2.3 |

TABLE 6

| Select strength characteristics measured in the 45° direction | | | | | |
|---|---|---|---|---|---|
| ID. | CRA | Final Thickness | UTS | YS | % E |
| Comp. Ex. A | 68% | 0.00108" (0.0275 mm) | 202 ksi (1392 MPa) | 184 ksi (1268 MPa) | 2.0 |
| Comp. Ex. B | 65% | 0.00118" (0.03 mm) | 202 ksi (1392 MPa) | 184 ksi (1268 MPa) | 1.9 |
| Comp. Ex. C | 65% | 0.00157" (0.04 mm) | 203 ksi (1399 MPa) | 189 ksi (1302 MPa) | 2.1 |

As shown in Tables 1-3, the process as described herein consistently produces copper-beryllium alloy products that demonstrate surprising strength characteristics in the longitudinal direction—for example, ultimate tensile strength greater than or about 1500 MPa, 0.2% offset yield strength greater than or about 1470 MPa, and/or percentage of elongation at break greater than or about 1.8%.

In contrast, as shown in Tables 4-6, the copper-nickel-tin alloy products demonstrate, in the longitudinal direction, ultimate tensile strength about 1400 MPa, 0.2% offset yield strength about 1370 MPa, and/or percentage of elongation at break about 1.6% or 1.7%.

Thus, when compared to the copper-nickel-tin alloy products, the copper-beryllium alloy products produced using the process described herein demonstrate, in the longitudinal direction, over 100 MPa or 7.1% improvement in ultimate tensile strength, and/or over 100 MPa or 7.3% improvement in 0.2% offset yield strength. Additionally, the copper-beryllium alloy products further demonstrate improved percentage of elongation at break.

Unexpectedly, as also shown in Tables 1-3, the copper-beryllium alloy products also consistently demonstrate comparable or even better strength characteristics in the transverse direction and the 45° direction as compared to along the longitudinal direction.

In contrast, as shown in Tables 4-6, the copper-nickel-tin alloy products demonstrate reduced 0.2% offset yield strength in the transverse direction and the 45° direction as compared to along the longitudinal direction. Thus, due to the reduced strength characteristics in the transverse direction and the 45° direction, the copper-nickel-tin alloy products may impose limitations on how the alloy products can be subsequently processed and/or fitted into a final product.

The copper-beryllium alloy products produced using the process described herein were tested for fatigue strength performance, as carried out in accordance with ASTM E796-94 (2000). FIGS. 3A-3D plot fatigue strength as a function of cycles for Examples 1-4, respectively. As a comparison, FIGS. 3A-3D also show a line indicating the average of the fatigue strengths for Comparative Examples A-C (the same line appears in FIGS. 3A-3D). The disclosed copper-beryllium alloy products outperform the copper-nickel-tin alloy products. FIGS. 3A-3D show the surprising improvements in fatigue testing demonstrated by Examples 1-4 (upper line) over Comparative Examples A-C (lower line).

Figure 3A:
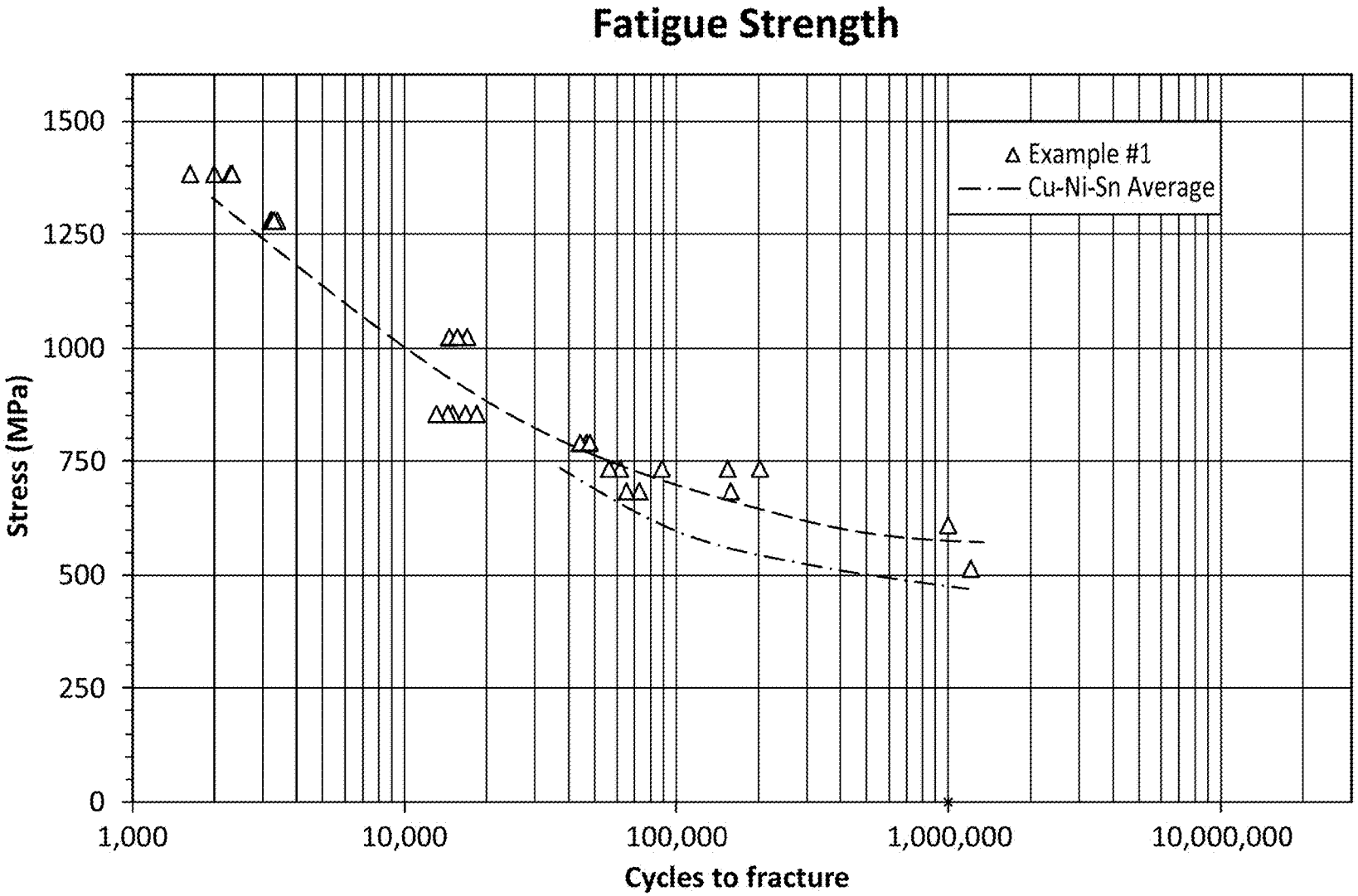
FIGS. 3A-3D are graphs showing fatigue test results for exemplary copper-beryllium alloy products.
Figure 3B:
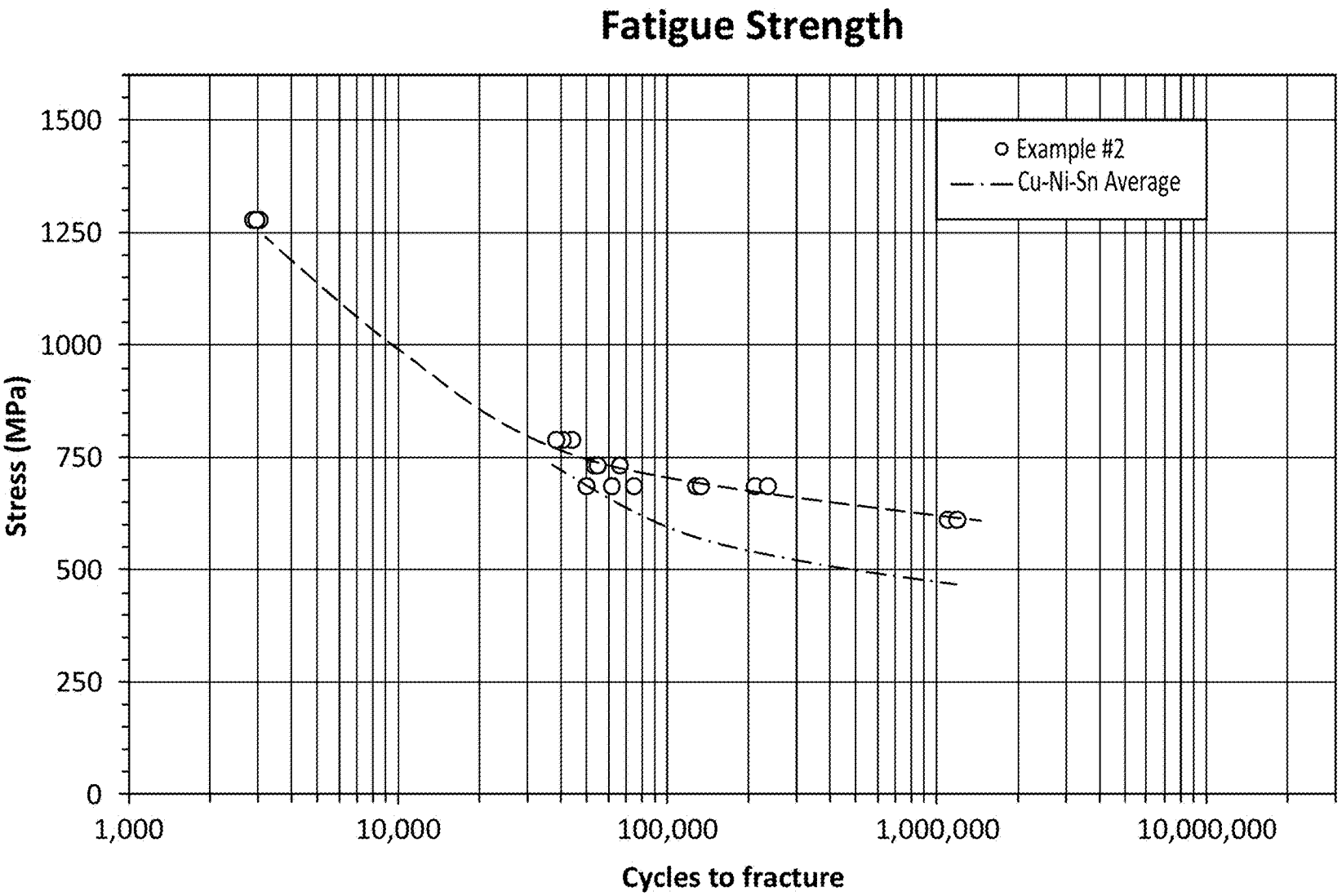
Figure 3C:
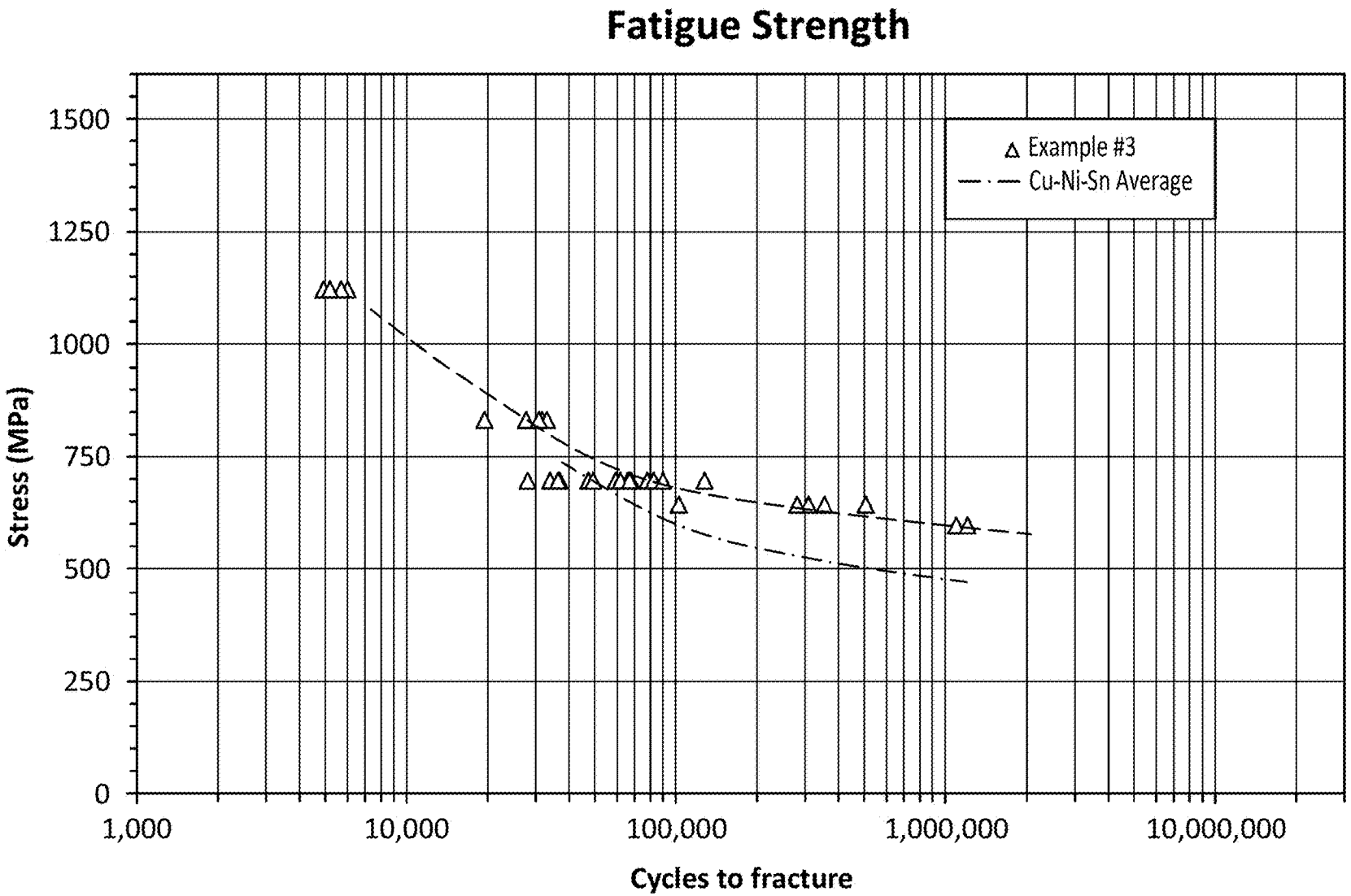
Figure 3D:
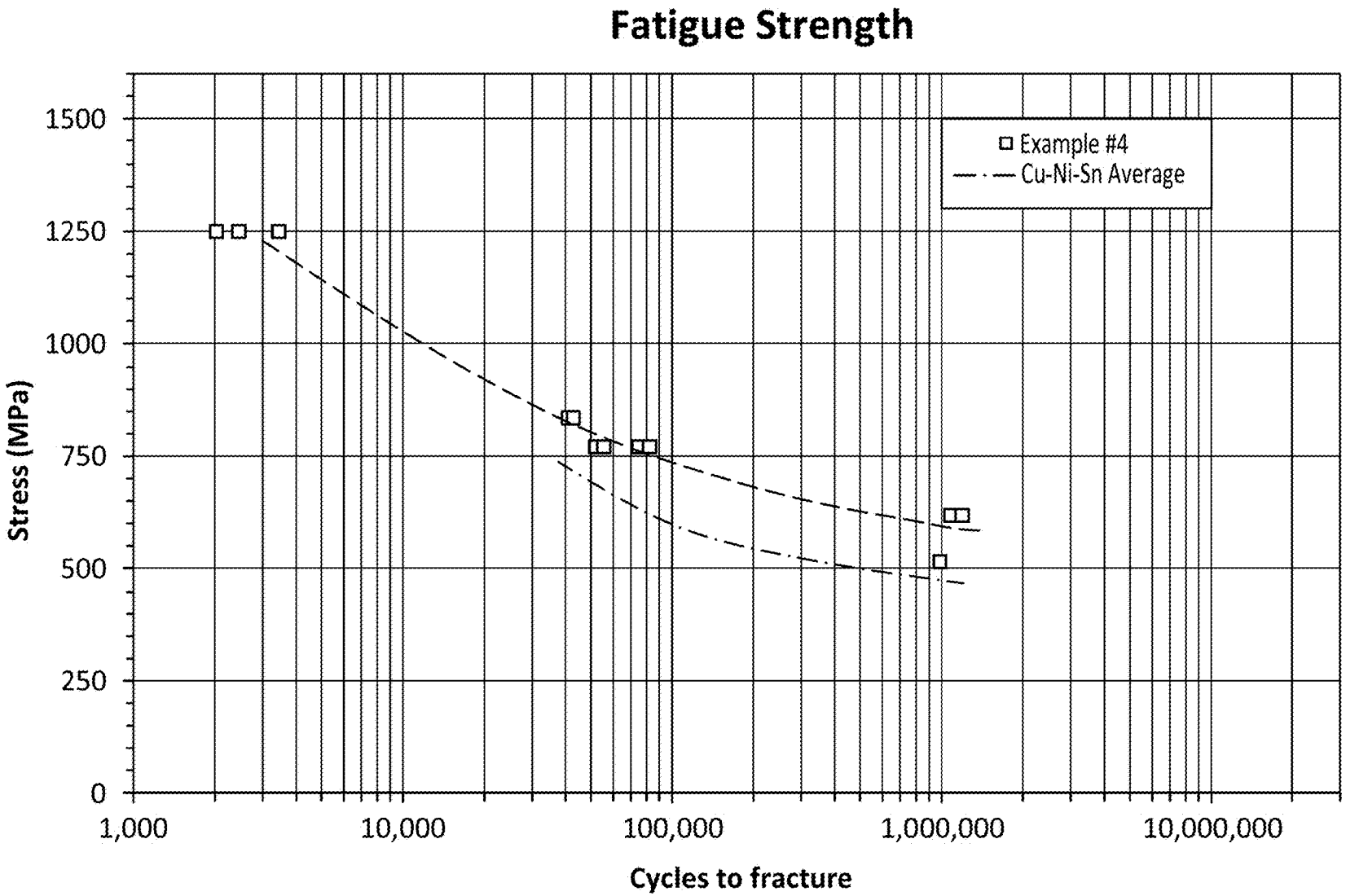

In particular, Examples 1-4 demonstrate exceptionally high fatigue strength after $10^4$ cycles of testing, after $10^5$ cycles of testing, or even after $10^6$ cycles of testing. These fatigue strength values are significantly higher than those for Comparative Examples A-C. For example, as shown in FIG. 3A, at $10^6$ cycles, Example 1 demonstrates a fatigue stress of about or over 600 MPa, while the Comparative average demonstrates fatigue stress of about 450 MPa. Example 1 demonstrates a significant improvement in the fatigue strength, e.g., at least 30%, when compared to the Comparative average.

As shown by Examples 1-4 and Comparative Examples A-C, the copper-beryllium alloy products produced using the process described herein consistently demonstrate superior strength characteristics over the copper-nickel-tin alloy products. Additionally, the copper-beryllium alloy products produced using the process described herein demonstrate comparable or better strength characteristics in the transverse direction and the 45° direction as compared to along the longitudinal direction. The copper-nickel-tin alloy products demonstrate lower strength, such as lower 0.2% offset yield strength, in the transverse direction and the 45° direction as compared to the longitudinal direction. Thus, the copper-beryllium alloy products not only enable wider applications, especially those requiring high strength performance, but also provide flexibility for subsequent processing and fitting of the alloy products into the final products.

Moreover, the copper-beryllium alloy products can be produced more efficiently by cold working the copper-beryllium base alloy once to achieve 75% of CRA. In contrast, the production of the copper-nickel-tin alloy products involve two cold working steps with each achieving 40% to 45% of CRA so as to obtain the highest strength values for the copper-nickel-tin alloy products. Thus, the copper-beryllium alloy products produced using the processed described herein offer both performance and production advantages over existing alloy products and processes.

Examples 5-7

Examples 5-7 were prepared using processes similar to that for preparing Examples 1-4, except that different percentages of CRA were applied at step 2 for different examples. Specifically, Examples 5, 6, and 7 were cold worked by cold rolling to achieve about (or slightly over) 40% of CRA, 58% of CRA, and 70% of CRA, respectively. The grain structures for Examples 5, 6, and 7 are shown in FIGS. 2A, 2B, and 2C, respectively. The grain orientation of Examples 5, 6, and 6 were 40°-45°; ~10°; and ~0°, respectively.

Figure 4A:
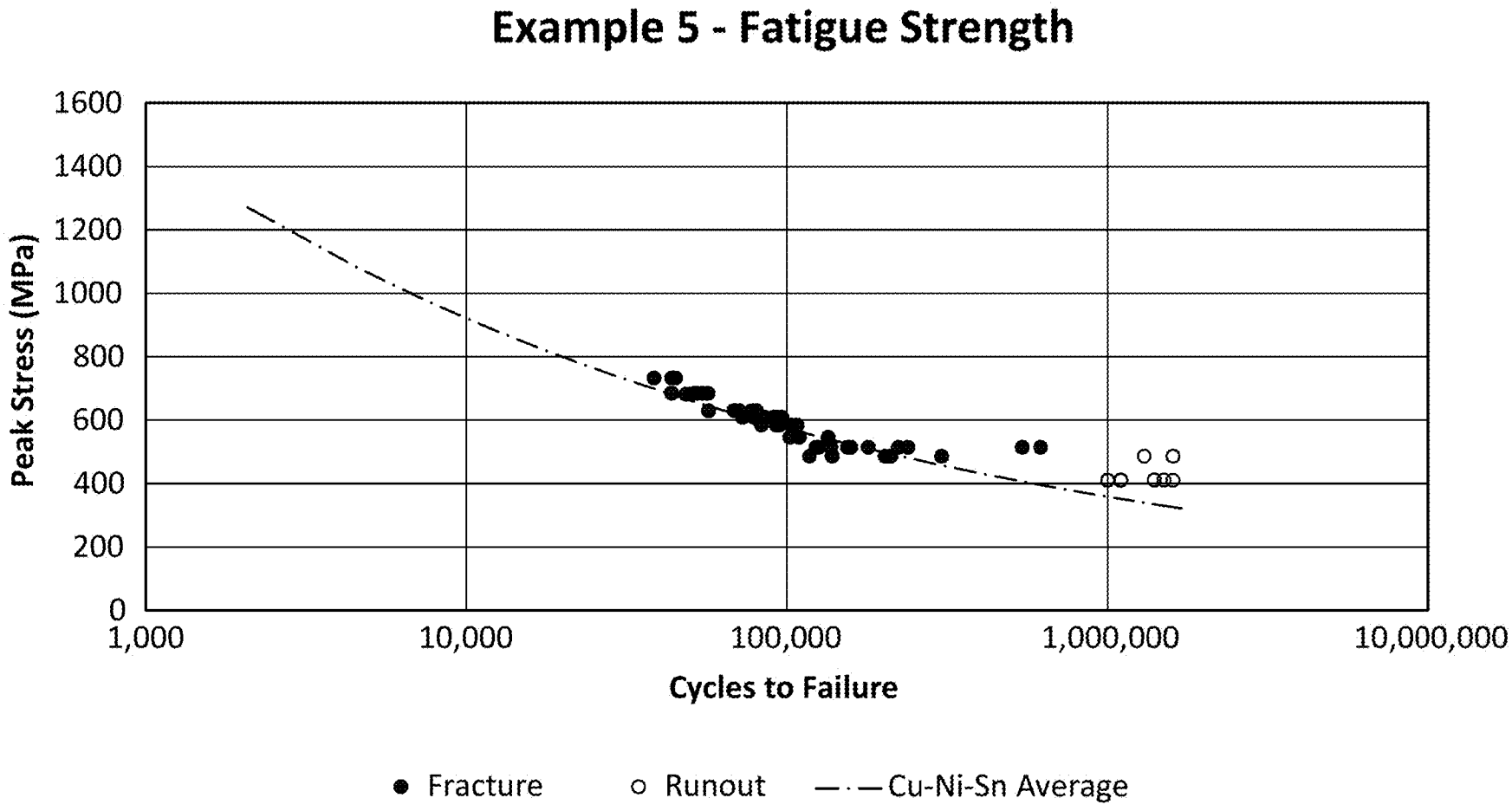
FIGS. 4A-4D are graphs showing additional fatigue test results for exemplary copper-beryllium alloy products.
Figure 4B:
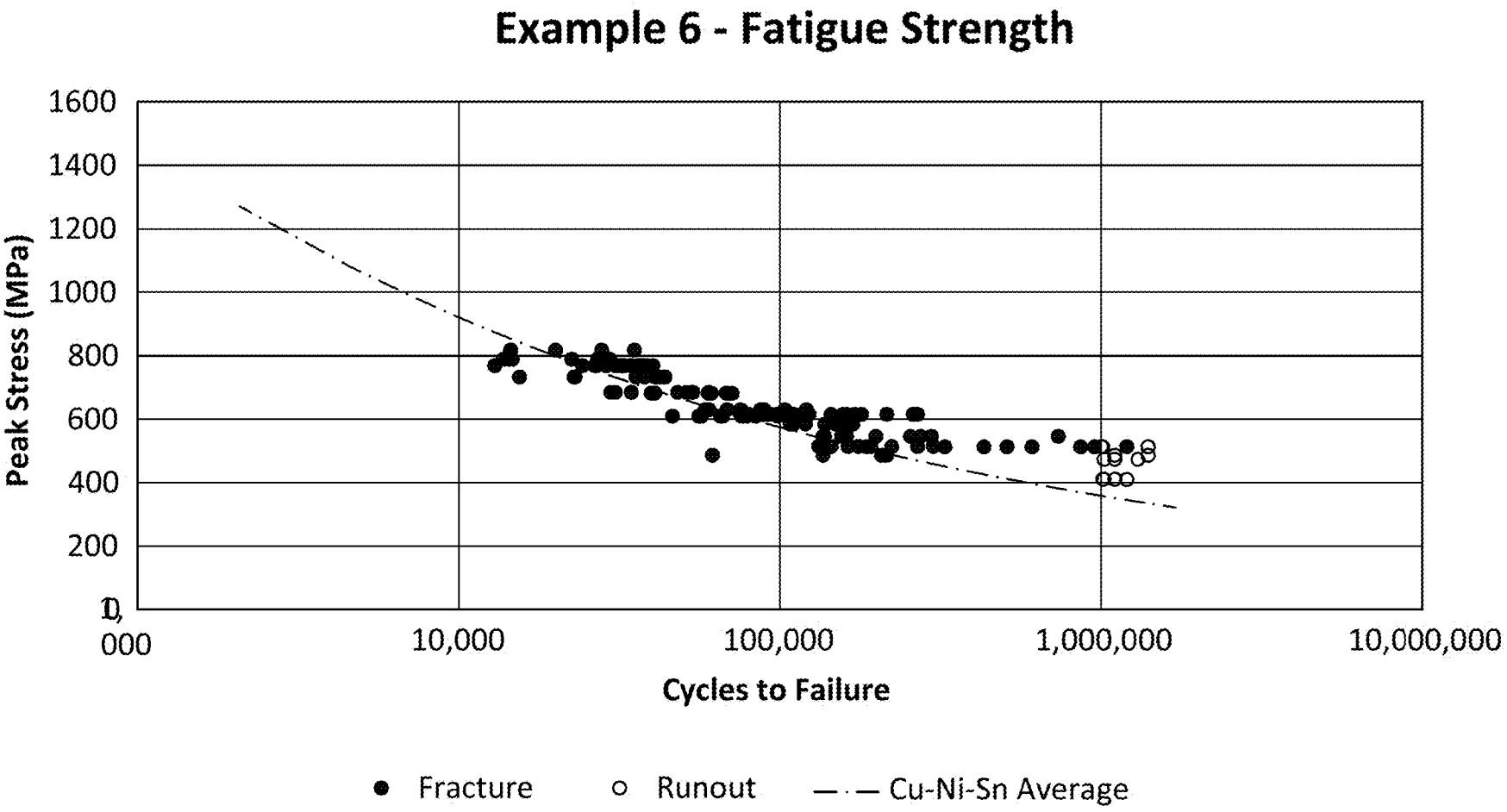
Figure 4C:
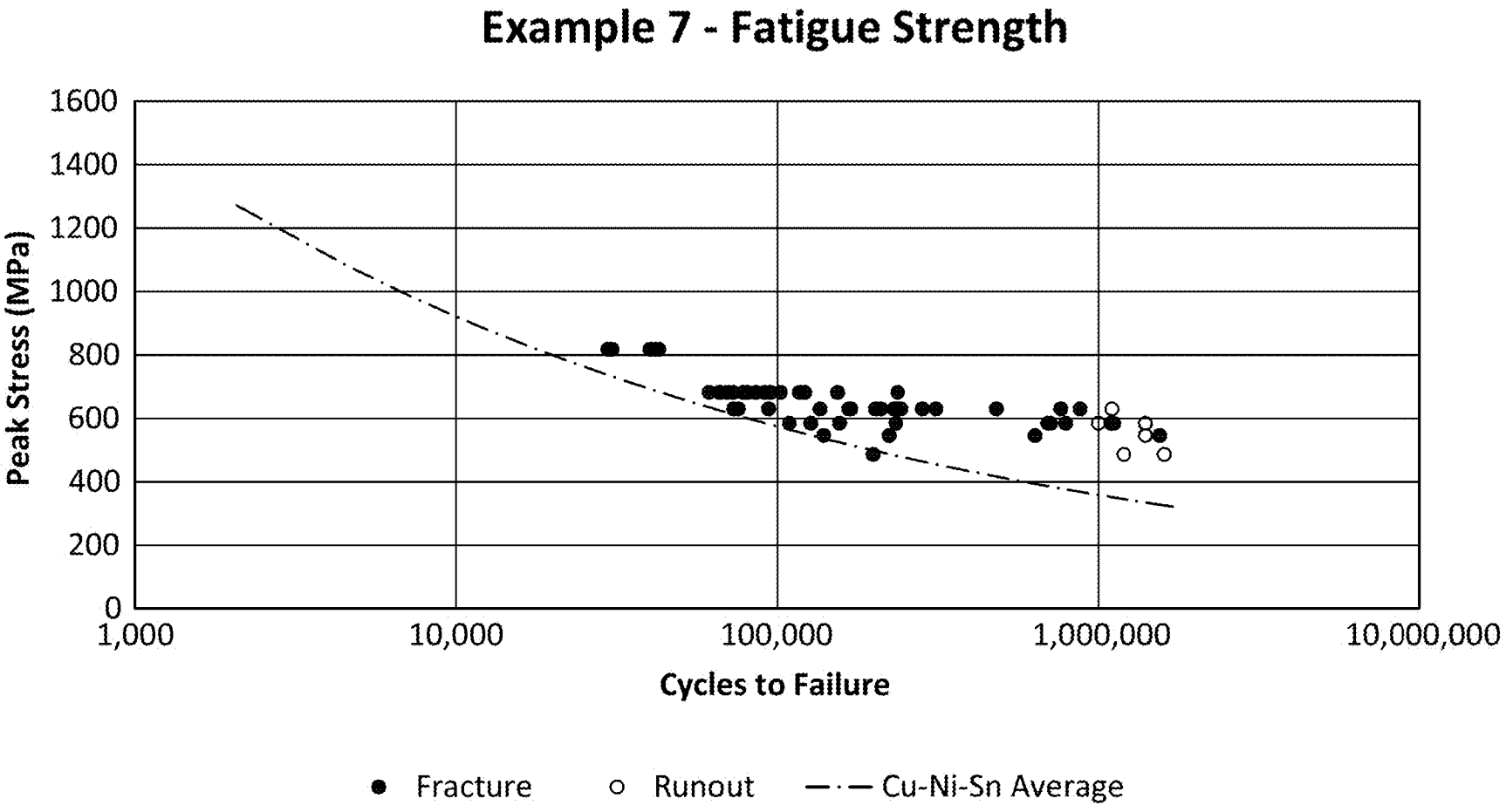
Figure 4D:
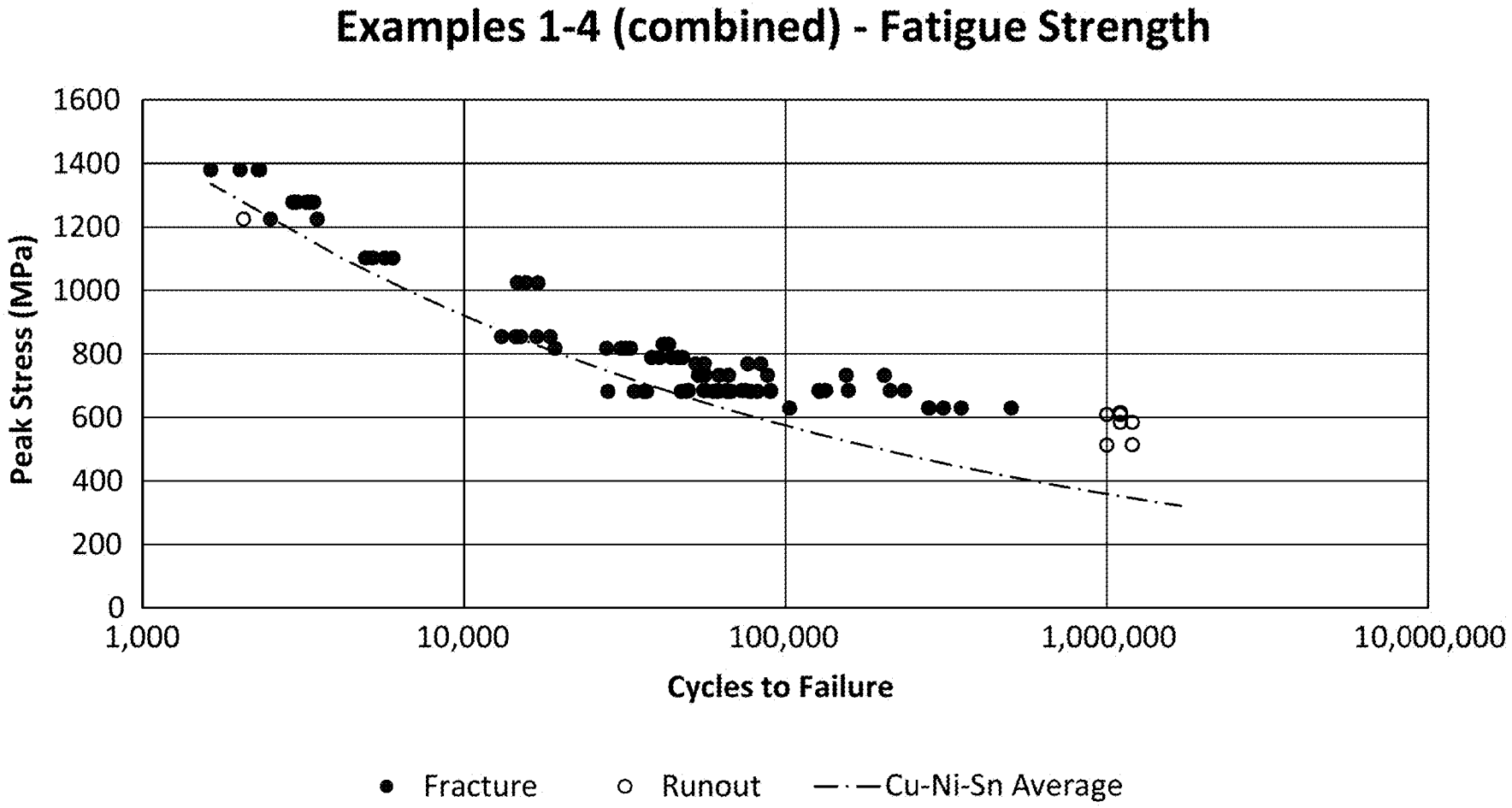
Figure 5A:
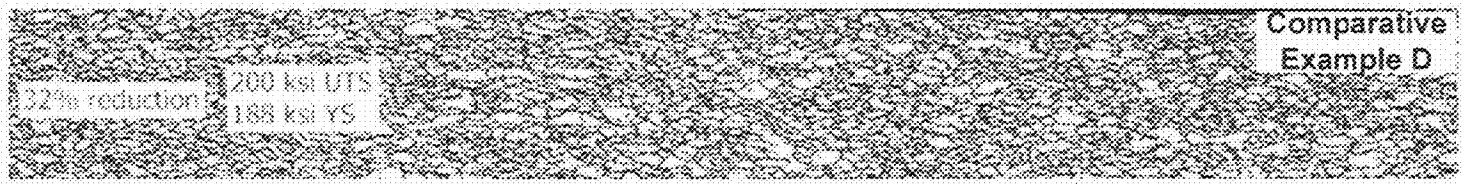
FIGS. 5A-5G show the microstructures of additional copper-beryllium alloy products.
Figure 5B:
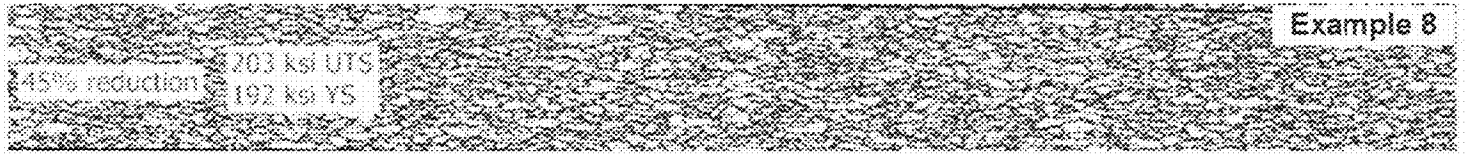
Figure 5C:
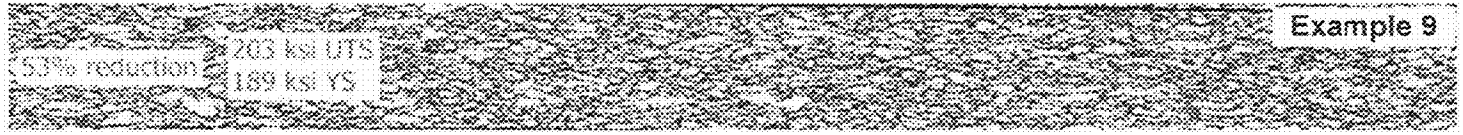
Figure 5D:
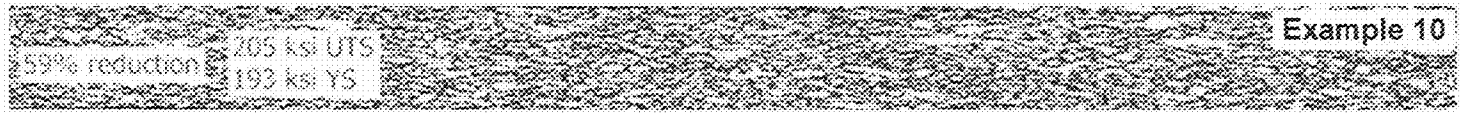
Figure 5E:
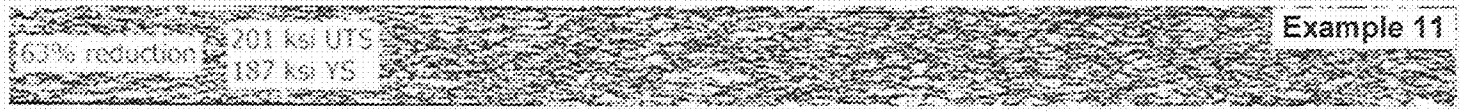
Figure 5F:
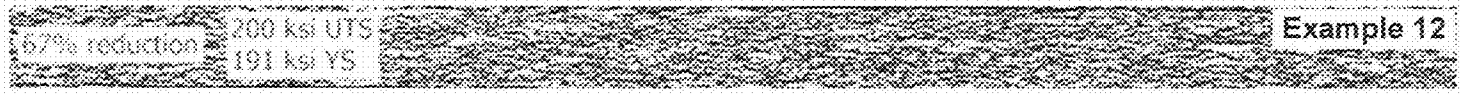
Figure 5G:
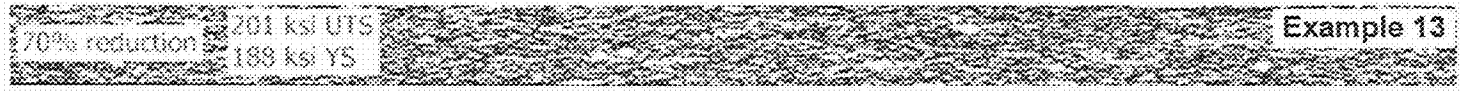

Examples 5-7 were tested for fatigue strength as described above. FIGS. 4A-4C show the fatigue test result data points of Examples 5-7, respectively. FIG. 4D shows the combined fatigue test result data points of Examples 1-4 (at a CRA of ~75%) discussed above. Fatigue strength for Examples 5-7, at $10^6$ cycles of testing, was approximately 400 MPa, 450 MPa, and 500 MPa, respectively.

As a comparison, FIGS. 4A-4D also show a line indicating the average of the fatigue strengths for copper-nickel-tin alloy products at 65% to 70% of CRA (the same line appears in FIGS. 4A-4D).

As shown in FIGS. 4A-4D, as the percentage of CRA increased, the fatigue strength performance of the copper-beryllium alloy products increased—the data points show better performance compared to the Comparative average line as CRA increased.

In particular, the fatigue strength of all of Examples 1-7 outperformed the copper-nickel-tin alloy products at $10^6$ cycles of testing—the majority, if not all, of the data points are significantly higher than the Comparative average line. In fact, many of the Example data points show no fracture or fail ("Runout") even after $10^6$ cycles of testing.

Additionally, as the percentage of CRA increased, the copper-beryllium alloy products demonstrated better fatigue strength performance at broader ranges of cycles of testing. For example, as shown in FIG. 4B, at 58% of CRA, Example 6 demonstrated comparable or greater peak stress than the copper-nickel-tin alloy products when subjected to $10^5$ or greater number of cycles of testing. As shown in FIG. 4C, at 70% of CRA, Example 7 demonstrated greater peak stress than the copper-nickel-tin alloy products when subjected to $10^4$ or greater number of cycles of testing. As shown in FIG. D, at 75% of CRA, Examples 1-4 all demonstrated greater peak stress than the copper-nickel-tin alloy products at substantially all cycles of testing.

Examples 8-13 and Comparative Example D

Examples 8-13 were prepared using processes similar to that for preparing Examples 1-4, except that different percentages of CRA (all above 40% of CRA) were applied at step 2 for different Examples. Step 3 was not performed at this point. It is noted that the grain structure obtained at this point would be maintained upon completion of Step 3. Comparative Example D was prepared using processes similar to that for preparing Examples 8-13, except that a lower percentage of CRA (below 40%) was applied at step 2.

Table 7 below lists the percentage of CRA, orientation angle of grain structure, ultimate tensile strength (UTS), 0.2% offset yield strength (YS), and fatigue strength at $10^6$ cycles of testing (FS) (in the longitudinal direction) for Examples 8-13 and Comparative Example D. It is noted that the fatigue strength value for Example 13 is a tested value, whereas the fatigue strength values for Examples 8-12 and Comparative Example D are estimated values based on the tested fatigue strength values of Examples 1-4 at $10^6$ cycles of testing (in the longitudinal direction) as shown in Table 7 below.

TABLE 7

Grain structures and select strength characteristics in the longitudinal direction

| ID. | CRA | Grain Orientation Angle | FS | UTS | YS |
|---|---|---|---|---|---|
| Comp. Ex. D | 32% | 40°-45° (45° prevalent) | 55 ksi (380 MPa) | 200 ksi (1379 MPa) | 188 ksi (1295 MPa) |
| Ex. 8 | 45% | 30°-40° | 59.5 ksi (410 MPa) | 203 ksi (1399 MPa) | 192 ksi (1323 MPa) |
| Ex. 9 | 53% | about 20° | 63 ksi (435 MPa) | 203 ksi (1399 MPa) | 189 ksi (1302 MPa) |
| Ex. 10 | 59% | about 10° | 66 ksi (455 MPa) | 205 ksi (1413 MPa) | 193 ksi (1331 MPa) |
| Ex. 11 | 63% | close to 0° | 68 ksi (470 MPa) | 201 ksi (1386 MPa) | 187 ksi (1289 MPa) |
| Ex. 12 | 67% | close to 0° | 70.5 ksi 485 MPa | 200 ksi (1379 MPa) | 191 ksi (1317 MPa) |
| Ex. 13 | 70% | close to 0° | 72.5 ksi (500 MPa) | 201 ksi (1386 MPa) | 188 ksi (1295 MPa) |

As shown in Table 7, as the percentage of CRA increased, the fatigue strength of Examples 8-13 continued to increase. Importantly, when the percentage of CRA was less than 40%, e.g., 32% as in the case of Comparative Example D, although comparable ultimate tensile strength and/or yield strength may be achieved, the fatigue strength was significantly lower, e.g., less than 400 MPa, e.g., less than 385 MPa. Further, the ultimate tensile strength and the yield strength of Examples 8-13 were maintained and not compromised as the percentage of CRA continued to increase to higher levels.

FIGS. 5A-5G show the microstructures of Comparative Example D and Examples 8-13, respectively. As shown, when the percentage of CRA was less than 40%, such as in the case of Comparative Example D, a significant amount of the grains remained equiaxed and 45° grain orientation angle was prevalent. As the percentage of CRA was increased to greater than 40%, such as in the case of Examples 8-13, the grains became elongated and flattened, and the grain orientation angle reduced from 45° to close to 0°, such as in the cases of Examples 11-13. The elongated, flattened grain structure and the reduced grain orientation angle (e.g., less than 45° or even close to 0°) would be maintained upon completion of the heat treating at Step 3.

As mentioned above, the superior fatigue strength of the copper-beryllium alloy products described herein may be attributable to the elongated, flattened grain structure and/or reduced orientation of grain structures. As the percentage of CRA increases, e.g., to greater than 40%, the grains became more elongated and/or flattened, and the orientation angles of the grains were reduced, which led to reduced surface grain boundaries and reduced crack initiation sites and improved strength characteristics.

It is noted that the ultimate tensile strength and the yield strength values of Examples 8-13 shown in Table 7 were obtained prior to the heat treating at step 3. Thus, the ultimate tensile strength and the yield strength values of Examples 8-13 were lower than the ultimate tensile strength and the yield strength values of Examples 1-4. The inclusion of further heat treating would further improve the strength performance of Examples 8-13 to levels similar to those of Examples 1-4, while maintaining the elongated, flattened grain structure and the reduced grain orientation angle.

Nonetheless, the ultimate tensile strength and yield strength of Examples 8-13 were good and comparable to the ultimate tensile strength and yield strength of the copper-nickel-tin alloy products or Comparative Examples A-C as shown in Table 4. The copper-nickel-tin alloy products, however, required significantly more processing, e.g., more heat treating and/or cold working steps, to achieve the performance levels. Thus, using the process described herein, with or without further heat treatment (e.g., final strand aging), improved fatigue strength in combination with comparable or better ultimate tensile strength and yield strength can be achieved with fewer process steps (e.g., fewer cold working and/or heat treating steps). Therefore, not only can the production efficiency be improved by reducing process steps, comparable or superior strength characteristics can also be achieved.

Comparative Example E

Figure 6A:
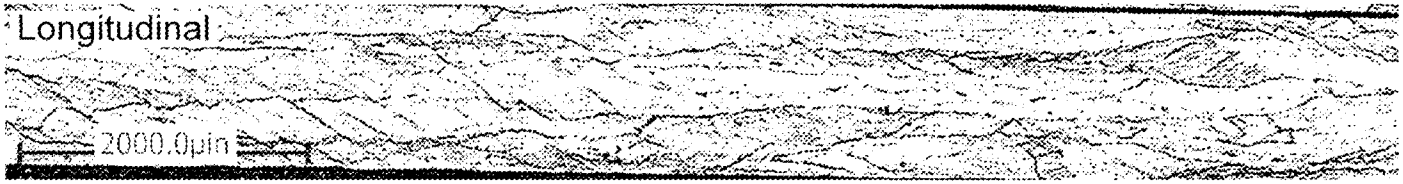
FIGS. 6A and 6B show the microstructures of exemplary processed copper-nickel-tin alloy products.
Figure 6B:
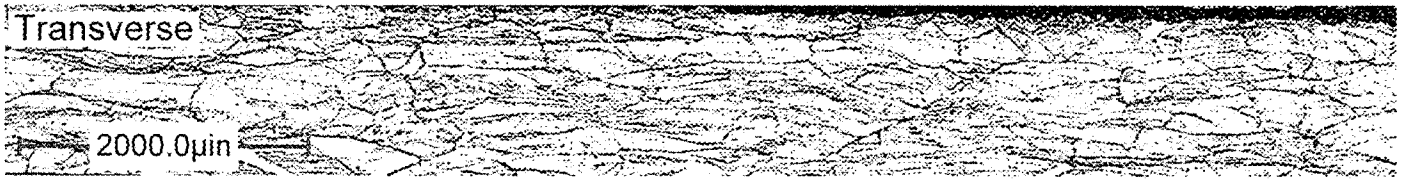

Additional Comparative Example E of a copper-nickel-tin product was prepared using process similar to that for preparing Comparative Examples A-C. Thus, the copper-nickel-tin alloy product was processed to achieve a total of 65% to 70% of CRA. FIGS. 6A and 6B show the microstructures of Comparative Example E of the processed copper-nickel-tin alloy product. FIG. 6A shows the microstructure in the longitudinal direction, and FIG. 6B shows the microstructure in the transverse direction. As shown in FIGS. 6A and 6B, the grains in both the longitudinal and transverse directions were coarse and not flattened even at a total of close to 70% of CRA. The grains demonstrated an aspect ratio ranging from 6:1 to 8:1 in the longitudinal direction, and an aspect ratio of about 2:1 in the transverse direction. Some residual grains even maintained a close to 1:1 aspect ratio or equiaxed grain structure in the transverse direction. Further, some grains (or grain boundaries) had an orientation angle of 30° to 45° in the longitudinal direction, while a significant number of grains (or grain boundaries) still maintained an orientation angle close to 45° in the transverse direction.

By comparing the grain structures shown in FIGS. 2A-2D and FIGS. 5B-5G and the grain structures shown in FIGS. 6A and 6B (Comparative), it can be seen that the copper-beryllium alloy products (FIGS. 2A-2D and FIGS. 5B-5G) produced using the process described herein demonstrate very different grain structures when compared to the copper-nickel-tin alloy products (FIGS. 6A and 6B). Even at very high percentages of CRA (e.g., about 70%), elongated, flattened grain structures obtained in the copper-beryllium alloy products at similar percentages of CRA cannot be obtained in the copper-nickel-tin alloy products.

It is postulated that the elongated, flattened grains of the copper-beryllium allowed the copper-beryllium alloy products to achieve superior strength characteristics that could not be achieved by the copper-nickel-tin alloy products having equiaxed, non-elongated, and/or coarse grains. The residual high orientation angle of the grain structure (e.g., close to45°) in the copper-nickel-tin alloy products detrimentally provided easy slip planes for fatigue crack initiation, whereas, for copper-beryllium alloys, the grain orientation angle was close to 0° when these products were cold worked to a high percentage of CRA, such as shown in FIGS. 2C and 2D, FIGS. 5E-5G, and Table 7, Examples 11-13.

Embodiments

The following embodiments are contemplated. All combinations of features and embodiments are contemplated.

Embodiment 1: a process for producing a copper-beryllium alloy product, the process comprising preparing a base alloy having 0.15 wt %-4.0 wt % beryllium and having grains and an initial cross section area; cold working the base alloy to a percentage of cold reduction of area (CRA) greater than 40%, based on the initial cross section area; and heat treating the cold worked alloy to produce the copper-beryllium alloy product; the grain structure of the copper-beryllium alloy product has an orientation angle of less than 45° relative to the cold working surfaces when viewed along the direction of the cold working; and the copper-beryllium alloy product demonstrates a fatigue strength of at least 385 MPa after $10^6$ cycles of testing.

Embodiment 2: the embodiment of embodiment 1, wherein the base alloy is cold worked to a percentage of CRA ranging from 70% to 80%.

Embodiment 3: the embodiment of any of embodiments 1 and 2, wherein heat treating of the cold worked alloy is performed at a temperature of 600° F. to 700° F. for a period of 1 minutes to 5 minutes.

Embodiment 4: the embodiment of any of embodiments 1-3, wherein preparing the base alloy comprises preliminarily cold working an alloy sheet to a thickness of less than 0.01 inches.

Embodiment 5: the embodiment of any of embodiments 1-4, wherein preparing the base alloy further comprises heat treating the preliminarily cold worked alloy to produce the base alloy.

Embodiment 6: the embodiment of any of embodiments 1-5, wherein the heat treating of the preliminarily cold worked alloy comprises solution annealing and aging.

Embodiment 7: the embodiment of any of embodiments 1-6, wherein the solution annealing is performed at a temperature of 1350° F. to 1450° F. for a period of 0.5 minutes to 5 minutes.

Embodiment 8: the embodiment of any of embodiments 1-7, wherein the aging is performed at a temperature of 450° F. to 650° F. for a period of 2 hours to 4 hours.

Embodiment 9: the embodiment of any of embodiments 1-8, wherein the copper-beryllium alloy product demonstrates an ultimate tensile strength of at least 200 ksi along the direction of the cold working.

Embodiment 10: the embodiment of any of embodiments 1-9, wherein the ultimate tensile strength of the copper-beryllium alloy product as measured transverse to the direction of the cold working is greater than the ultimate tensile strength as measured in the direction of the cold working by 5% to 10%.

Embodiment 11: the embodiment of any of embodiments 1-10, wherein the copper-beryllium alloy product demonstrates a 0.2% offset yield strength of at least 200 ksi along the direction of the cold working.

Embodiment 12: the embodiment of any of embodiments 1-11, wherein the 0.2% offset yield strength of the copper-beryllium alloy product as measured transverse to the direction of the cold working is greater than the 0.2% offset yield strength as measured in the direction of the cold working by 5% to 10%.

Embodiment 13: the embodiment of any of embodiments 1-12, wherein the ultimate tensile strength of the cold worked alloy is greater than the ultimate tensile strength of the base alloy by 10% to 30%.

Embodiment 14: the embodiment of any of embodiments 1-13, wherein the ultimate tensile strength of the copper-beryllium alloy product is greater than the ultimate tensile strength of the base alloy by 15% to 50%.

Embodiment 15: the embodiment of any of embodiments 1-14, wherein the 0.2% offset yield strength of the cold worked alloy product is greater than the 0.2% offset yield strength of the base alloy by 20% to 40%.

Embodiment 16: the embodiment of any of embodiments 1-15, wherein the 0.2% offset yield strength of the copper-beryllium alloy product is greater than the 0.2% offset yield strength of the base alloy by 25% to 70%.

Embodiment 17: the embodiment of any of embodiments 1-16, wherein the grains of the copper-beryllium alloy product are elongated in the direction of the cold working.

Embodiment 18: the embodiment of any of embodiments 1-17, wherein the grains of the copper-beryllium alloy product have an aspect ratio of length to thickness greater than 1:1.

Embodiment 19: the embodiment of any of embodiments 1-18, wherein the grain structure orientation angle of the copper-beryllium alloy product is less than 15°.

Embodiment 20: the embodiment of any of embodiments 1-19, wherein the amount of fatigue initiation sites in the copper-beryllium alloy product is less than the amount of fatigue initiation sites in the base alloy by an amount of 1% to 35%.

Embodiment 21: a copper-beryllium alloy product, comprising 0.5-4.0 wt % beryllium; and copper and having grains; the grains of the copper-beryllium alloy product being generally elongated in a common direction and the grain structure has an orientation angle of less than 45° when viewed along the direction of the grain elongation; the copper-beryllium alloy product having a fatigue strength of at least 385 MPa after $10^6$ cycles of testing.

Embodiment 22: the embodiment of embodiment 21, wherein the grains have an aspect ratio of length to thickness ranging from 1:1 to 9:1.

Embodiment 23: the embodiment of any of embodiments 21 and 22, wherein the grain structure orientation angle is less than 15°.

Embodiment 24: the embodiment of any of embodiments 21-23, wherein the copper-beryllium alloy product has an ultimate tensile strength of at least 200 ksi along the direction of the grain elongation.

Embodiment 25: the embodiment of any of embodiments 21-24, wherein the copper-beryllium alloy product has an ultimate tensile strength of at least 200 ksi transverse to the direction of the grain elongation.

Embodiment 26: the embodiment of any of embodiments 21-25, wherein the ultimate tensile strength transverse to the direction of the grain elongation is greater than the ultimate tensile strength in the direction of the grain elongation by 5% to 10%.

Embodiment 27: the embodiment of any of embodiments 21-26, wherein the copper-beryllium alloy product has a 0.2% offset yield strength of at least 200 ksi along the direction of the grain elongation.

Embodiment 28: the embodiment of any of embodiments 21-27, wherein the copper-beryllium alloy product has a 0.2% offset yield strength of at least 200 ksi transverse to the direction of the grain elongation.

Embodiment 29: the embodiment of any of embodiments 21-28, wherein the 0.2% offset yield strength transverse to the direction of the grain elongation is greater than the 0.2% offset yield strength in the direction of the grain elongation by 5% to 10%.

Embodiment 30, the embodiment of any of embodiments 21-29, wherein the copper-beryllium alloy product has been cold worked to achieve a percentage of cold reduction of area (CRA) greater than 40%, based on an initial cross section area of a base alloy.

Embodiment 31, the embodiment of any of embodiments 21-30, wherein the copper-beryllium alloy product has been cold worked to achieve a percentage of cold reduction of area (CRA) of 70% to 80%, based on an initial cross section area of a base alloy.

Embodiment 32, the embodiment of any of embodiments 21-31, wherein the copper-beryllium alloy product includes less than 0.2 wt % of titanium.

Embodiment 33, the embodiment of any of embodiments 21-32, wherein the copper-beryllium alloy product includes less than 0.2 wt % of tin.

Embodiment 34, the embodiment of any of embodiments 21-33, wherein the copper-beryllium alloy product comprises 1.8-2.0% beryllium.

While the invention has been described in detail, modifications within the spirit and scope of the invention will be readily apparent to those of skill in the art. In view of the foregoing discussion, relevant knowledge in the art and references discussed above in connection with the Background and Detailed Description, the disclosures of which are all incorporated herein by reference. In addition, it should be understood that aspects of the invention and portions of various embodiments and various features recited below and/or in the appended claims may be combined or interchanged either in whole or in part. In the foregoing descriptions of the various embodiments, those embodiments which refer to another embodiment may be appropriately combined with other embodiments as will be appreciated by one of skill in the art. Furthermore, those of ordinary skill in the art will appreciate that the foregoing description is by way of example only, and is not intended to limit.

We claim:

1. A process for producing a copper-beryllium alloy product, the process comprising:

preparing a base alloy having 0.15 wt %-4.0 wt % beryllium and having grains and an initial cross section area;

cold rolling the base alloy to a percentage of cold reduction of area (CRA) of 40% to 80%, based on the initial cross section area; and heat treating the cold worked alloy to produce the copper-beryllium alloy product;

wherein the grain structure of the copper-beryllium alloy product has an orientation angle of less than 40° relative to the cold rolling surfaces when viewed along the direction of the cold rolling; and wherein the copper-beryllium alloy product demonstrates a fatigue strength of at least 385 MPa after $10^6$ cycles of testing, wherein the grains of the copper-beryllium alloy product are elongated or flattened in the direction of the cold rolling; and wherein the copper-beryllium alloy product demonstrates an ultimate tensile strength of at least 200 ksi along the direction of the cold rolling.

2. The process of claim 1, wherein heat treating of the cold rolled alloy is performed at a temperature of 600° F. to 700° F. for a period of 1 minutes to 5 minutes.

3. The process of claim 1, wherein preparing the base alloy comprises preliminarily cold working an alloy sheet to a thickness of less than 0.01 inches.

4. The process of claim 3, wherein preparing the base alloy further comprises heat treating the preliminarily cold worked alloy to produce the base alloy.

5. The process of claim 4, wherein the heat treating of the preliminarily cold worked alloy comprises solution annealing and aging.

6. The process of claim 5, wherein the solution annealing is performed at a temperature of 1350° F. to 1450° F. for a period of 0.5 minutes to 5 minutes.

7. The process of claim 5, wherein the aging is performed at a temperature of 450° F. to 650° F. for a period of 2 hours to 4 hours.

8. The process of claim 1, wherein the ultimate tensile strength of the copper-beryllium alloy product as measured transverse to the direction of the cold rolling is greater than the ultimate tensile strength as measured in the direction of the cold rolling by 5% to 10%.

9. The process of claim 1, wherein the copper-beryllium alloy product demonstrates a 0.2% offset yield strength of at least 200 ksi along the direction of the cold rolling.

10. The process of claim 1, wherein the 0.2% offset yield strength of the copper-beryllium alloy product as measured transverse to the direction of the cold rolling is greater than the 0.2% offset yield strength as measured in the direction of the cold rolling by 5% to 10%.

11. The process of claim 1, wherein the grain structure orientation angle of the copper-beryllium alloy product is less than 15°.

12. The process of claim 1, wherein the amount of fatigue initiation sites in the copper-beryllium alloy product is less than the amount of fatigue initiation sites in the base alloy by an amount of 1% to 35%.

13. A process for producing a copper-beryllium alloy product, the process comprising:

preparing a base alloy having 0.15 wt %-4.0 wt % beryllium and having grains and an initial cross section area;

cold rolling the base alloy to a percentage of cold reduction of area (CRA) of 40% to 80%, based on the initial cross section area; and heat treating the cold worked alloy to produce the copper-beryllium alloy product;

wherein the grain structure of the copper-beryllium alloy product has an orientation angle of less than 40° relative to the cold rolling surfaces when viewed along the direction of the cold rolling; and wherein the copper-beryllium alloy product demonstrates a fatigue strength of at least 385 MPa after $10^6$ cycles of testing, wherein the grains of the copper-beryllium alloy product are elongated or flattened in the direction of the cold rolling;

wherein the copper-beryllium alloy product demonstrates a 0.2% offset yield strength of at least 200 ksi along the direction of the cold rolling.

14. The process of claim 13, wherein heat treating of the cold rolled alloy is performed at a temperature of 600° F. to 700° F. for a period of 1 minutes to 5 minutes.

15. The process of claim 13, wherein preparing the base alloy comprises preliminarily cold working an alloy sheet to a thickness of less than 0.01 inches.

16. The process of claim 15, wherein preparing the base alloy further comprises heat treating the preliminarily cold worked alloy to produce the base alloy, wherein the heat treating comprises solution annealing and aging.

17. The process of claim 16, wherein the solution annealing is performed at a temperature of 1350° F. to 1450° F. for a period of 0.5 minutes to 5 minutes and wherein the aging is performed at a temperature of 450° F. to 650° F. for a period of 2 hours to 4 hours.

18. The process of claim 13, wherein the copper-beryllium alloy product demonstrates an ultimate tensile strength of at least 200 ksi along the direction of the cold rolling.

19. The process of claim 13, wherein the ultimate tensile strength of the copper-beryllium alloy product as measured transverse to the direction of the cold rolling is greater than the ultimate tensile strength as measured in the direction of the cold rolling by 5% to 10%; and wherein the 0.2% offset yield strength of the copper-beryllium alloy product as measured transverse to the direction of the cold rolling is greater than the 0.2% offset yield strength as measured in the direction of the cold rolling by 5% to 10%.

20. The process of claim 13, wherein the grain structure orientation angle of the copper-beryllium alloy product is less than 15°.

* * * * *